US007063080B2

(12) United States Patent
Kita et al.

(10) Patent No.: US 7,063,080 B2
(45) Date of Patent: Jun. 20, 2006

(54) CYLINDER-BY-CYLINDER AIR-FUEL RATIO CONTROLLER FOR INTERNAL COMBUSTION ENGINE

(75) Inventors: Masayuki Kita, Kariya (JP); Noriaki Ikemoto, Obu (JP)

(73) Assignee: Denso Corporation, Kariya (JP)

( * ) Notice: Subject to any disclaimer, the term of this patent is extended or adjusted under 35 U.S.C. 154(b) by 7 days.

(21) Appl. No.: 11/000,950

(22) Filed: Dec. 2, 2004

(65) Prior Publication Data

US 2005/0121010 A1 Jun. 9, 2005

(30) Foreign Application Priority Data

Dec. 4, 2003 (JP) ..... 2003-405572
Aug. 31, 2004 (JP) ..... 2004-251201

(51) Int. Cl.
*F02D 41/14* (2006.01)

(52) U.S. Cl. ..... 123/673; 701/109

(58) Field of Classification Search ..... 123/480, 123/673; 701/109
See application file for complete search history.

(56) References Cited

U.S. PATENT DOCUMENTS 5,636,621 A * 6/1997 Maki et al. ..... 123/673
5,657,736 A 8/1997 Maki et al. ..... 123/673
5,806,506 A 9/1998 Kitamura et al. ..... 123/673
6,188,953 B1 * 2/2001 Yasui et al. ..... 701/109
6,499,474 B1 * 12/2002 Wachi et al. ..... 123/673

FOREIGN PATENT DOCUMENTS

JP 6-200809 7/1994

* cited by examiner

*Primary Examiner*—T. M. Argenbright
(74) *Attorney, Agent, or Firm*—Nixon & Vanderhye P.C.

(57) ABSTRACT

An air-fuel ratio sensor detects an air-fuel ratio of an exhaust gas at a confluent portion of an exhaust gas. An air-fuel ratios in each cylinder are estimated to be controlled based on an output of the air-fuel ratio sensor. A computer determines whether an air-fuel detecting timing deviates according to a dispersion of the estimated air-fuel ratio among cylinders. When the deviation is detected, the air-fuel ratio detecting timing is varied to estimate an air-fuel ratio before and after correcting amount of fuel. The air-fuel ratio detecting timing is adapted as a proper timing when the variation amount of the estimated air-fuel ratio before and after the correction of fuel amount corresponds to the correct amount of fuel.

14 Claims, 17 Drawing Sheets

OUTPUT OF AFR SENSOR · CORRECT AMOUNT OF FUEL · CRANK COUNTER

CYLINDER-BY-CYLINDER AIR-FUEL RATIO CONTROLLER FOR INTERNAL COMBUSTION ENGINE

CROSS REFERENCE TO RELATED APPLICATION

This application is based on Japanese Patent Applications No. 2003-405572 filed on Dec. 4, 2003, and No. 2004-251201 filed on Aug. 31, 2004, the disclosures of which are incorporated herein by reference.

FIELD OF THE INVENTION

The present invention relates to a cylinder-by-cylinder air-fuel ratio controller for an-internal combustion engine, which is capable of estimating an air-fuel ratio in each cylinder based on an output of an air-fuel ratio sensor disposed at the confluent portion of exhaust manifolds.

BACKGROUND OF THE INVENTION

Japanese Patent 3217680, which is counterpart of U.S. Pat. No. 5,657,736, discloses a fuel metering control system in order to decrease a deviation of the air-fuel ratio between the cylinders to enhance an accuracy of air-fuel ratio control. In the fuel control system, a model showing an activity in the exhaust system is established. An air-fuel ratio sensor is disposed at a confluent portion of exhaust manifolds to detect an air-fuel ratio of an exhaust gas. The value of the air-fuel ratio detected by the air-fuel ratio sensor is input into the model. An observer estimates an air-fuel ratio of an air-fuel mixture in each cylinder, and corrects a quantity of fuel injected into each cylinder according a deviation between the estimated air-fuel ratio and a target air-fuel ratio, so that the air-fuel ratio in each cylinder is closed to the target air-fuel ratio. The period from the time in which the exhaust gas comes around the air-fuel sensor to the time in which the air-fuel ratio is detected varies according to an operation condition of engine. The period is referred to as a response delay in exhaust system. The response delay in exhaust system varies according to the operation condition of engine. The relationship between the response delay in exhaust system and the operation condition of the engine is stored in a map at the time of designing and producing the engine, on which a sample timing of the air-fuel ratio sensor corresponding to a detecting timing of the air-fuel ratio sensor is varied. The response delay in exhaust system is varied according to not only the operation condition of engine but also ageing of the air-fuel ratio sensor.

JP-10-73049A, which is a counterpart of U.S. Pat. No. 5,806,506, disclose an engine control system in which a deteriorate parameter indicative of ageing is calculated by measuring the response delay after fuel injection is cut, and the sample timing of the air-fuel ratio sensor is varied based on the deteriorate parameter and the operation condition of engine.

However, in the conventional systems, it is difficult to accurately correct the sample timing of the air-fuel ratio sensor, because the response delay varies depend on each engine. The length of the exhaust manifold, which is from an exhaust port to the air-fuel sensor, varies every cylinder, and the flow stream of exhaust gas in each cylinder intricately varies according to the engine speed and the quantity of air filled in the cylinder. Thus, it is difficult to establish a precise map on which the relationship between the response delay in exhaust system and the operation condition of engine is mapped.

SUMMARY OF THE INVENTION

The present invention is made in view of the foregoing matter and it is an object of the preset invention to detect or correct the deviation of the sample timing of the air-fuel ratio sensor while the engine is running.

It is the other object of the present invention to adapt and correct the deviation of the sample timing.

According to the present invention, a cylinder-by-cylinder air-fuel ratio controller includes an air-fuel ratio sensor detecting an air-fuel ratio of an exhaust gas, the air-fuel ratio sensor being disposed in a confluent portion into which the exhaust gas from each cylinder flows. The controller includes an air-fuel ratio estimating means which estimates air-fuel ratios cylinder-by-cylinder based on an output of the air-fuel ratio sensor every air-fuel ratio detecting timing, an air-fuel ratio control means which controls the air-fuel ratio of each cylinder based on an estimated air-fuel ratios, and a determining means which determines a deviation of the air-fuel ratio detecting timing based on a dispersion of the estimated air-fuel ratio among the cylinders while the air-fuel ratio control means controls the air-fuel ratio.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT

An embodiment of the present invention will be described hereinafter with reference to the drawings.

First Embodiment

Figure 1:
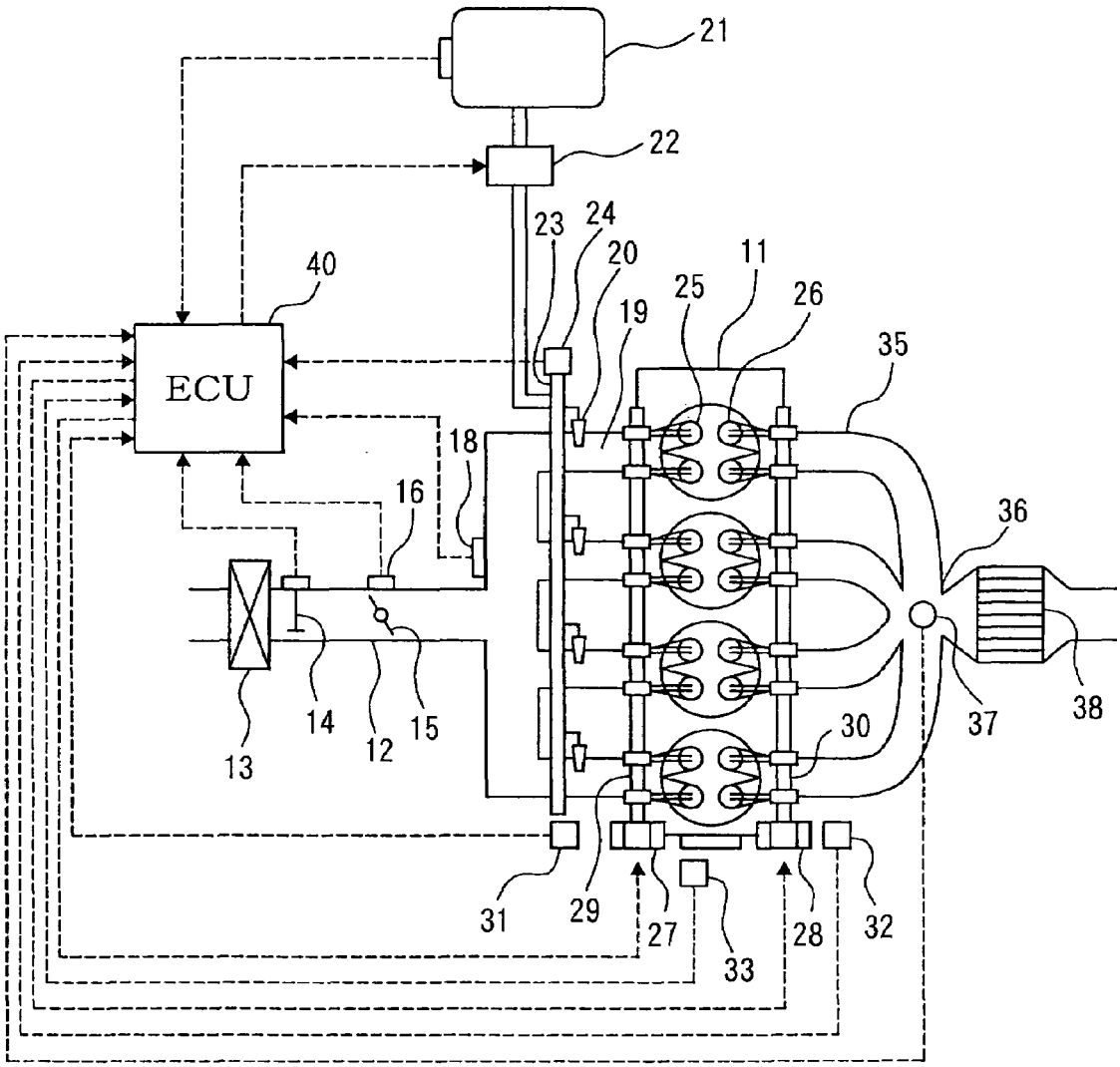
FIG. 1 is a schematic view of an engine control system according to a first embodiment of the present invention.

Referring to FIGS. 1 to 10, the first embodiment is described. FIG. 1 schematically shows an engine control system. A four-cylinder engine 11 has an intake pipe 12 for introducing an air there into. The intake pipe 12 is provided with an air cleaner 13 upstream end thereof, and is provided with an airflow meter 14 downstream of the air cleaner 13 for measuring an amount of air flowing through the intake pipe 12. A throttle valve 15 of which opening degree is controlled by a DC motor (not shown), and a throttle opening sensor 16 detecting the opening degree of the throttle valve 15 are provided downstream of the air flow meter 15.

A surge tank 17 is provided downstream-of the throttle valve 15, and a pressure sensor 18 detecting an air pressure is provided at the surge tank 17. An intake manifold 19 introducing the air into each cylinder communicates with the surge tank 19. At the vicinity of the intake port, a fuel injection valve 20 is provided. While the engine is running, the fuel in a fuel tank 21 is supplied to a delivery pipe 23 by the fuel pump 22 to be injected into each of the cylinder through the fuel injection valve 20 every injection timing for each cylinder. The delivery pipe 23 is provided with a fuel pressure sensor 24.

The engine 11 is equipped with an intake valve-timing controller 27 and an exhaust valve-timing controller 28. The intake valve-timing controller 27 adjusts an opening and closing timing of an intake valve 25, the exhaust valve-timing controller 28 adjusts an opening and closing timing of an exhaust valve 26. The engine 11 is equipped with an intake cam sensor 31 and an exhaust cam sensor 32 which output cam signals in synchronization with rotations of an intake camshaft 29 and an exhaust camshaft 30. The engine 11 is equipped with a crank angle sensor 33 which outputs a crank angle signal every 30°CA in synchronized with a rotation of the crankshaft.

An air-fuel sensor 37 is provided at a confluent portion 36 of the exhaust manifolds 35. A three-way catalyst 38 purifying an exhaust gas containing CO, HC, NOx is provided downstream of air-fuel sensor 37.

The output signals of the sensor such as the air-fuel ratio sensor 37 are input in an electric control unit 40, which is referred to as the ECU 40. The ECU 40 mainly comprises a microcomputer having a ROM (Read Only Memory) in which in which a control program is stored to control an amount of fuel injected by the fuel injection valve 20 and an ignite timing.

Figure 2:
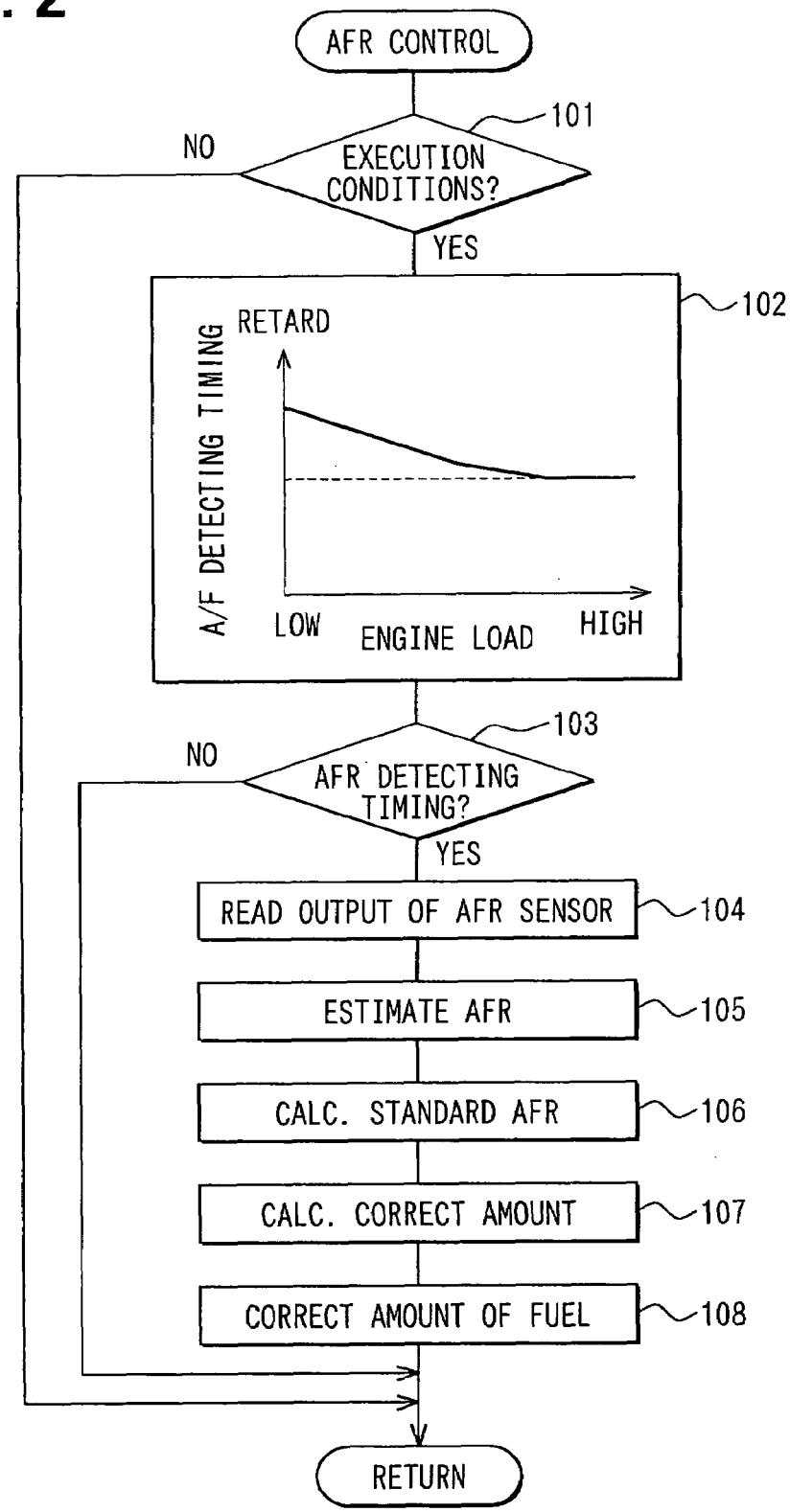
FIG. 2 is a flowchart showing an air-fuel ratio control routine according to the first embodiment.

The ECU 40 executes the air-fuel ratio control routine shown in FIG. 2. The ECU 40 estimates the air-fuel ratio of each cylinder based on the detected value of the air-fuel ratio sensor 37, and calculates the average of estimated air-fuel ratio of all cylinders to establish the standard air-fuel ratio (target air-fuel ratio of all cylinders). The ECU 40 calculate a deviation between the estimated air-fuel ratio and the standard air-fuel ratio every cylinder to obtain the correct amount of fuel to be injected into each cylinder. Thereby, the deviation of air-fuel ratio among every cylinder is reduced.

The model which estimates the air-fuel ratio of each cylinder, which is referred to as the air-fuel ratio estimate model, based on the output of the air fuel ratio sensor 37 is described herein after.

The historical data of the estimated air-fuel ratio at the confluent portion 36 is multiplied by a certain value, and the historical data of the output of the air-fuel ratio sensor 37 is multiplied by a certain value. Considering a gas exchange at the confluent portion 36, the output of the air-fuel ratio sensor 37 is modeled by adding two of the historical data. The air-fuel ratio of each cylinder is estimated by using the model. The Kalman filter is used as an observer.

The model of gas exchange at the confluent portion 36 is approximately expressed as following equation (1).

$$ys(t)=k1\times u(t-1)+k2\times u(t-2)-k3\times ys(t-1)\ -k4\times ys(t-2) \tag{1}$$

ys is an output of the air-fuel ratio sensor 37, u is an air-fuel ratio at the confluent portion 36, and k1 to k4 is constants.

In the exhaust system, a first delay factor due to flowing and mixing of gas at the confluent portion 36, and a first delay factor due to response delay of the air-fuel ratio sensor 37 exist. In the above equation (1), past two historical data are referred.

By converting the equation (1) into the state space model, the following equations (2a), (2b) are derived.

$$X(t+1)=A\cdot X(t)+B\cdot u(t)+W(t) \tag{2a}$$

$$Y(t)=C\cdot X(t)+D\cdot u(t) \tag{2b}$$

Here, A, B, C, D are parameters of the model, Y is the output of the air-fuel ratio sensor 37, X is the estimated air-fuel ratio of each cylinder, and W is a noise.

The Kalman filter is designed as following equation (3) based on the equation (2a), (2b).

$$X^{-}(K+1|k)=A\ X^{-}(X^{-}(k|K-1)\ +K\{y(k)-C\cdot A\cdot X^{-}(k|k-1)\} \tag{3}$$

Here, $X^{-}$is a estimated air-fuel ratio in each cylinder, K is a Kalman gain.

$X^{-}(k+1|k)$ is the estimated air-fuel ratio at the time of (k+1) based on the ratio at the time of (k).

The air-fuel ratio of each cylinder can be estimated according as the combustion cycle is advanced by the air-fuel ratio estimate model which is comprised of the Kalman filter observer.

A method of setting the air-fuel ratio detecting timing (the sample timing of the air-fuel ratio sensor 37) is described herein after.

In the first embodiment, it is considered that the response delay of the air-fuel sensor 27 varies according to the operation condition of engine, so that the air-fuel ratio detecting timing is mapped according to the operation condition of engine, such as the engine load, the engine speed. Generally, the response delay increases according as the engine load decreases, thus the air-fuel ratio detecting timing is retarded according as the engine load decreases.

However, it is difficult to accurately map the relationship between the response delay in the exhaust system and the engine load, because the response delay varies depend on each engine. The length of the exhaust manifold, which is from an exhaust port to the air-fuel sensor, varies every cylinder, and the flow stream of exhaust gas in each cylinder intricately varies according to the engine speed and the quantity of air filled in the cylinder. Thus, it is difficult to establish a precise map on which the relationship between the response delay in exhaust system and the operation condition of engine is mapped. Thereby, the air-fuel ratio detecting timing may deviate from an appropriate air-furl ratio detecting timing.

Figure 4:
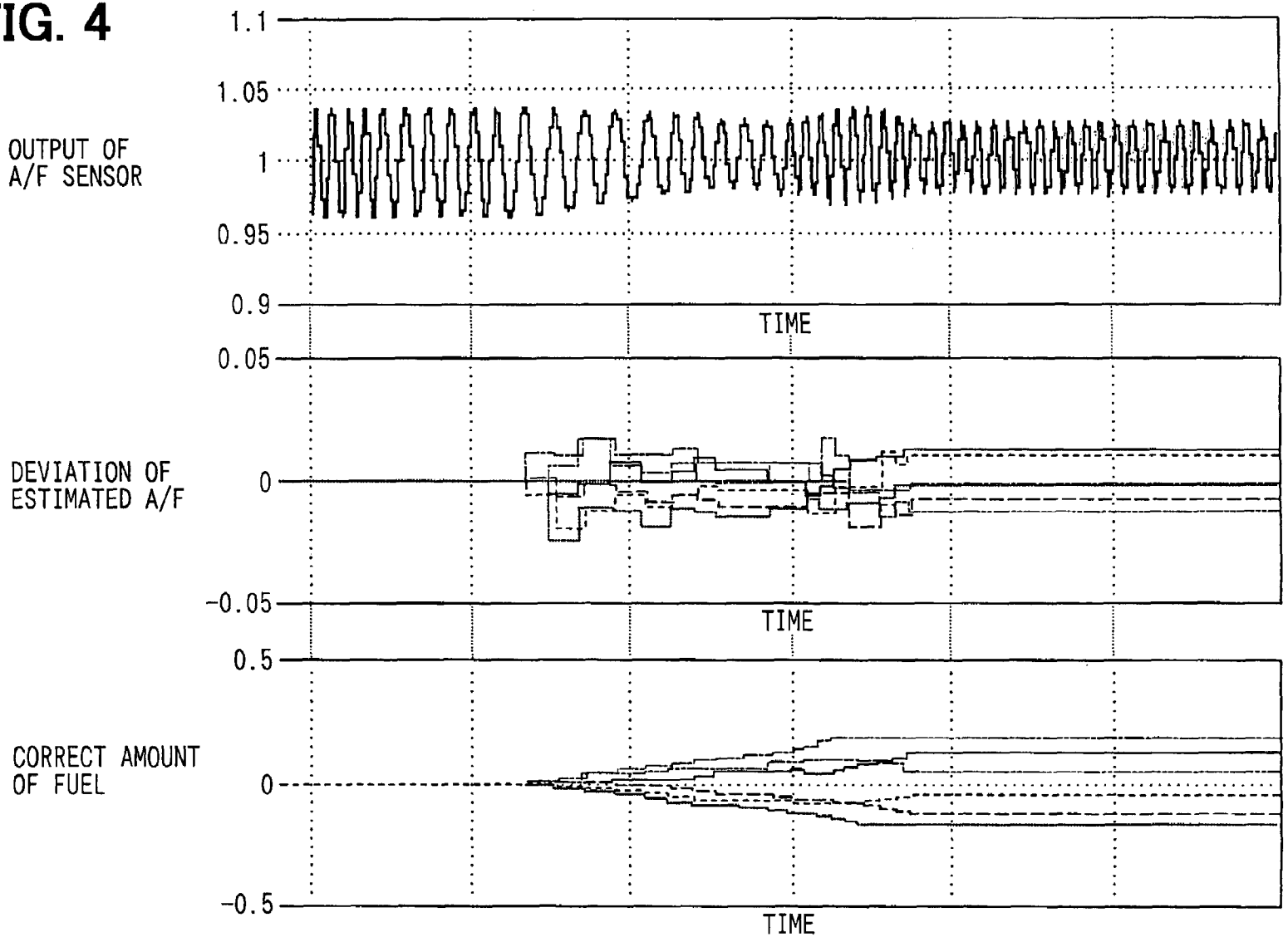
FIG. 4 is a time chart showing a controlling in which an air-fuel ratio detecting timing deviates.

As shown in FIG. 4, when the air-fuel ratio detecting timing deviates, the accuracy of estimated air-fuel ratio deteriorates so that the dispersion of the estimated air-fuel ratio hardly becomes small.

Figure 5:
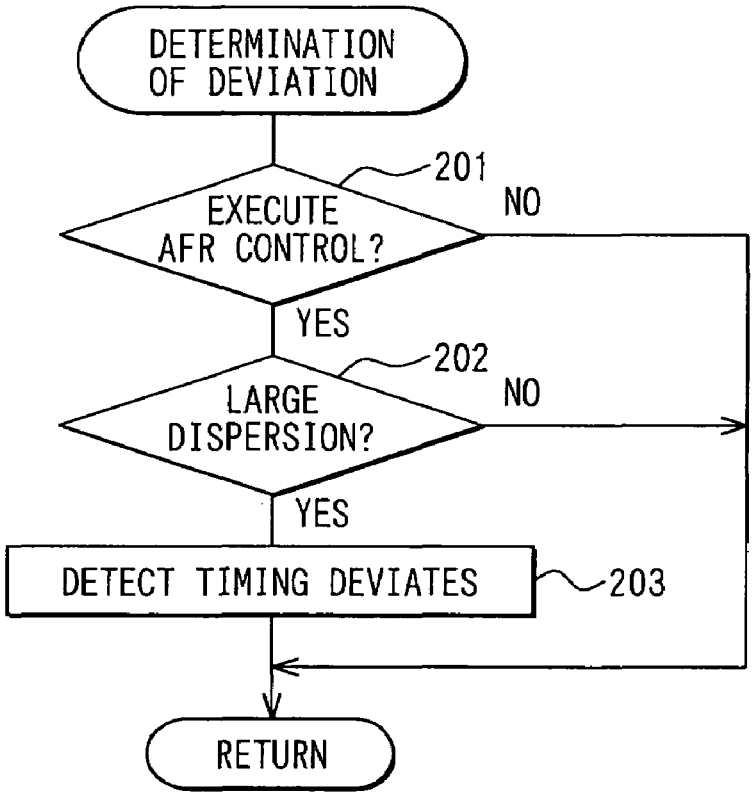
FIG. 5 is a flowchart showing a routine for determining a deviation of the air-fuel ratio detecting timing according to the first embodiment.

In the first embodiment, the routine program shown in FIG. 5 is executed to determine whether the air-fuel ratio detecting timing deviates or not based on the dispersion of the estimated air-fuel ratio.

The routine that the ECU 40 executes is described herein after.

(Cylinder-By-Cylinder Air-Fuel Ratio Control Routine)

The cylinder-by-cylinder air-fuel ratio control routine shown in FIG. 2 is executed every 30°CA in synchronization with the output pulse of the crank angle sensor 33. This control routine functions as a cylinder-by-cylinder air-fuel controlling means. In step 101, the computer determines whether an execution conditions are established or not. The execution conditions are following conditions (1) to (4), for example.

(1) The air-fuel sensor 37 is activated.

(2) It is not determined that the air-fuel sensor 37 is out of order.

(3) The engine is warmed up (the temperature of engine coolant is over a predetermined value).

(4) The engine is running under conditions, which is represented by the engine speed, the intake pipe pressure and the like, in which the accuracy of estimated air-fuel ratio is guaranteed.

When the above four conditions are satisfied, the execution conditions is established. When at least one of the conditions is not satisfied, the execution condition is not established to end the routine.

When the execution condition is established, the procedure proceeds to step 102, in which the air-fuel ratio detecting timing for each cylinder is determined based on the mapped engine load such as an intake pipe pressure. The air-fuel ratio detecting timing can be determined based on the mapped engine load and engine speed. The map on which the air-fuel ratio detecting timing is determined is corrected by adaptations correction routines illustrated in FIGS. 6, 7, the adaptations correction routine correcting the deviation of the air-fuel ratio detecting timing.

Next, the procedure proceeds to step 103, in which it is determined whether the present crank angle is the air-fuel ratio detecting timing determined in step 102. When it is No, the procedure ends.

When it is Yes in step 103, the procedure proceeds to step 104, in which the computer reads the output of the air-fuel ratio sensor 37. In step 105, the air-fuel ratio is estimated based on the output of the air-fuel ratio sensor 37 using the air-fuel ratio estimate model. The procedure in step 105 corresponds to the air-fuel ratio estimate means. In step 106, an average of the estimated air-fuel ratio of all cylinders is calculated to be established as a standard air-fuel ratio (the target air-fuel ratio for all cylinders).

In step 107, the deviation between the estimated air-fuel ratio and the standard air-fuel ratio is calculated to derive a correct amount of fuel in order to reduce the deviation. After that, the procedure proceeds to step 108, in which the amount of fuel to be supplied to each cylinder is corrected based on the correct amount of fuel, so that the air-fuel ratio of each cylinder is corrected to reduce the deviation of the air-fuel ratio.

(Routine for Determining an Existence of the Air-Fuel Ratio Detecting Timing Deviation)

Figure 3:
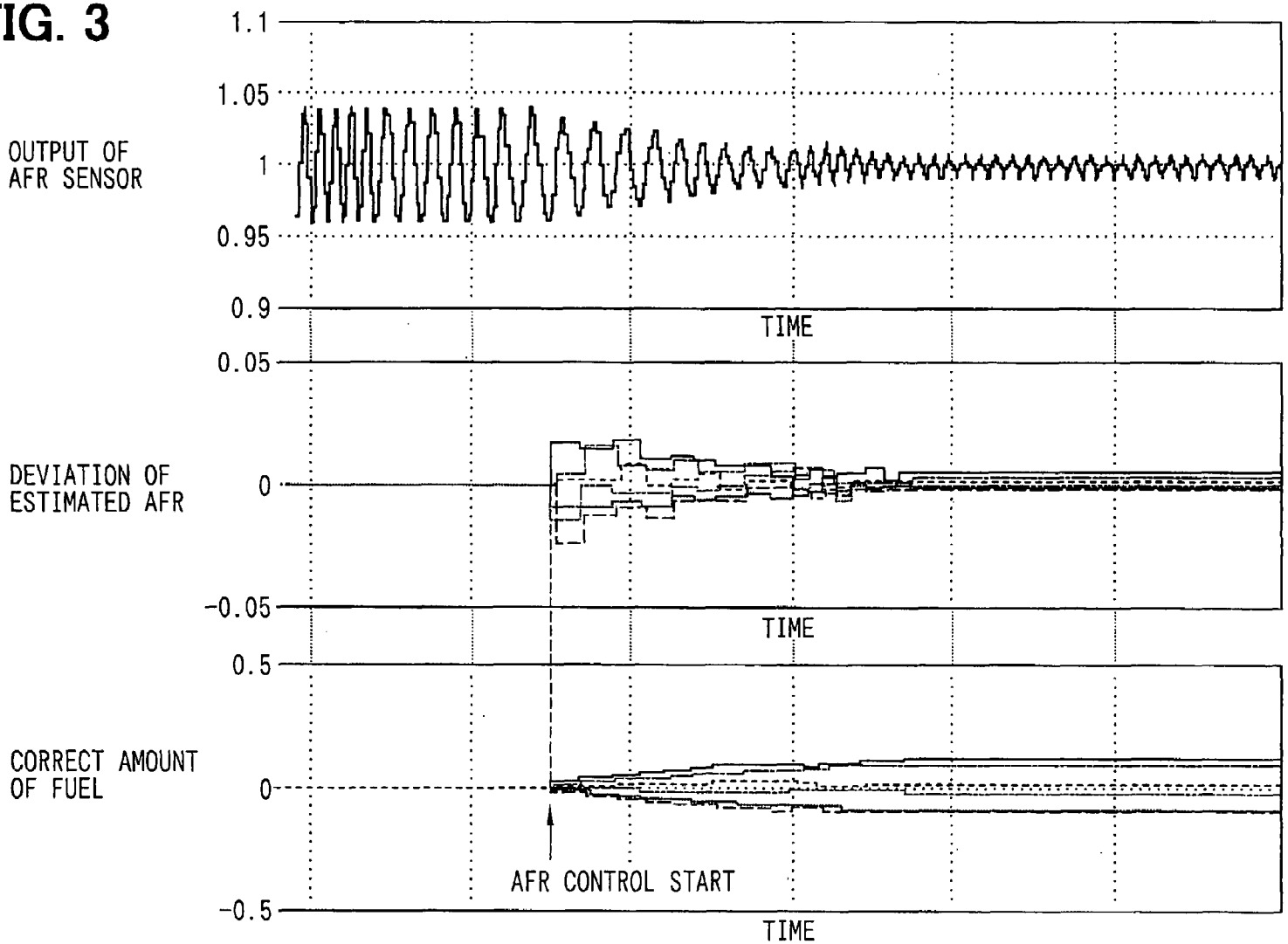
FIG. 3 is a time chart showing a controlling in which an air-fuel ratio detecting timing is proper.

The way of determining whether the air-fuel ratio detecting timing deviates or not is described, refereeing to time charts shown in FIGS. 3 and 4. FIG. 3 is the time chart showing that the air-fuel ratio detecting timing is proper. FIG. 4 is the time chart showing that the air-fuel detecting timing deviates.

When the air-fuel ratio detecting timing is proper, the deviation between the estimated air-fuel ratio and the standard air-fuel ratio decreases as shown in FIG. 3, because the air-fuel ratio is precisely estimated based on the output of the air-fuel ratio sensor 37. The deviation between the estimated air-fuel ratio and the standard air-fuel ratio is referred to as an estimated air-fuel ratio deviation.

On the contrary, when the air-fuel ratio detecting timing in each cylinder deviates, the estimated air-fuel ratio deviation hardly becomes small and the estimated air-fuel ratios in each cylinder still disperses, because the accuracy of estimated air-fuel ratio in each cylinder deteriorates.

Based on the character described above, in the first embodiment, the routine shown in FIG. 5, which determines whether the air-fuel ratio detecting timing deviates, is executed. The computer determines the existence of deviation of air-fuel ratio detecting timing according to the dispersion of estimated air-fuel ratio among cylinders. The present routine is executed every 30°CA of the crankshaft angle in synchronization with the output pulse of the crank angle sensor 33, and functions as a means for determining whether the air-fuel ratio detecting timing deviates. In step 201, it is determined whether cylinder-by-cylinder air-fuel ratio control routine is executed. When it is No, the procedure ends without executing following process.

When it is Yes in step 201, the procedure proceeds to step 202, in which the dispersion of estimated air-fuel ratio among cylinders is significantly large according to at least one of conditions (A1), and (A2) described below.

(A1) It is determined whether the dispersion is large according to whether the deference between the maximum estimated air-fuel ratio and the minimum estimated air-fuel ratio is larger than a predetermined value.

(A2) It is determined whether the dispersion is large according to whether the standard deviation of estimated air-fuel ratio of all cylinders is larger than a predetermined value.

In step 202, when it is determined that the dispersion of the estimated air-fuel ratio among cylinders is significantly large, the procedure proceeds to step 203, in which it is determined that the air-fuel ratio detecting timing deviates to end the routine. When it is No in step 202, it is determined that the air-fuel ratio detecting timing is proper to end the routine.

(Routine for Adaptations Correction of the Deviation of the Air-Fuel Ratio Detecting Timing)

Figure 8:
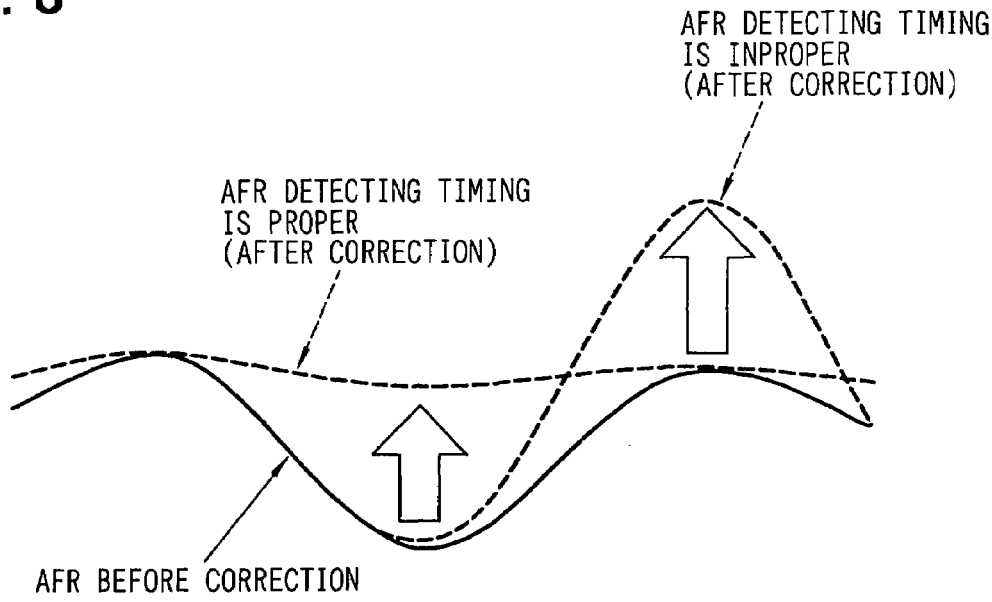
FIG. 8 is a time chart for explaining a way of detecting the deviation of the air-fuel ratio detecting timing according to the first embodiment.
Figure 9:
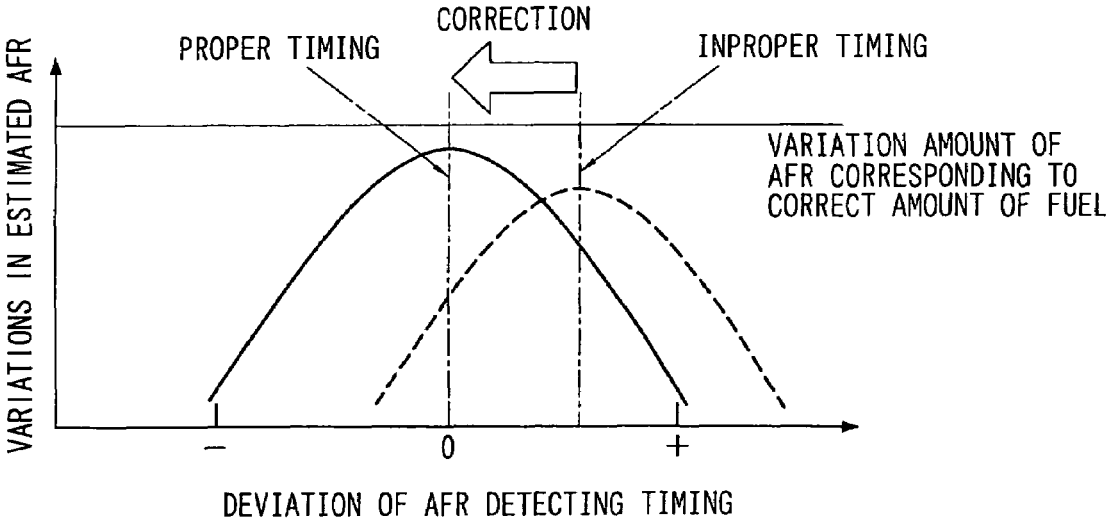
FIG. 9 is a graph for explaining a way of adaptations correction of the deviation of the air-fuel ratio detecting timing according to the first embodiment.
Figure 10:
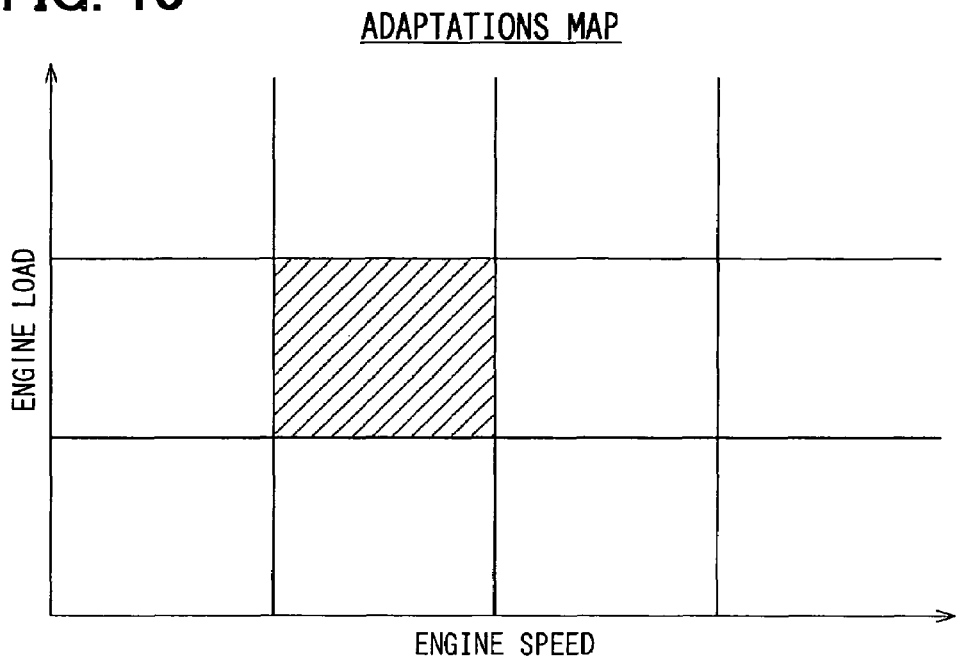
FIG. 10 is a map conceptually showing adaptations map of the air-fuel ratio detecting timing according to the first embodiment.

Referring to FIGS. 8, 9, the way of adaptations correction of deviation of the air-fuel ratio detecting timing is described hereinafter.

FIG. 8 and FIG. 9 are graphs for explaining an effect of correction of fuel amount in the event when the air-fuel ratio detecting timing is proper and in the event when the air-fuel ratio detecting timing deviates. When the air-fuel ratio detecting timing is proper, the air-fuel ratio in each cylinder is precisely estimated, so that the amount of fuel injection into the cylinder is corrected by a certain amount to change the air-fuel ratio corresponding to the corrected amount of fuel. According to the character described above, the adaptations correction routine is executed to change the air-fuel ratio detecting timing, and the air-fuel ratio is estimated before and after the air-fuel detecting timing is changed. The proper air-fuel ratio detecting timing is adapted in such a manner that the variation of estimated air-fuel ratio between before and after correction of fuel amount corresponds to the corrected amount of fuel.

Figure 6:
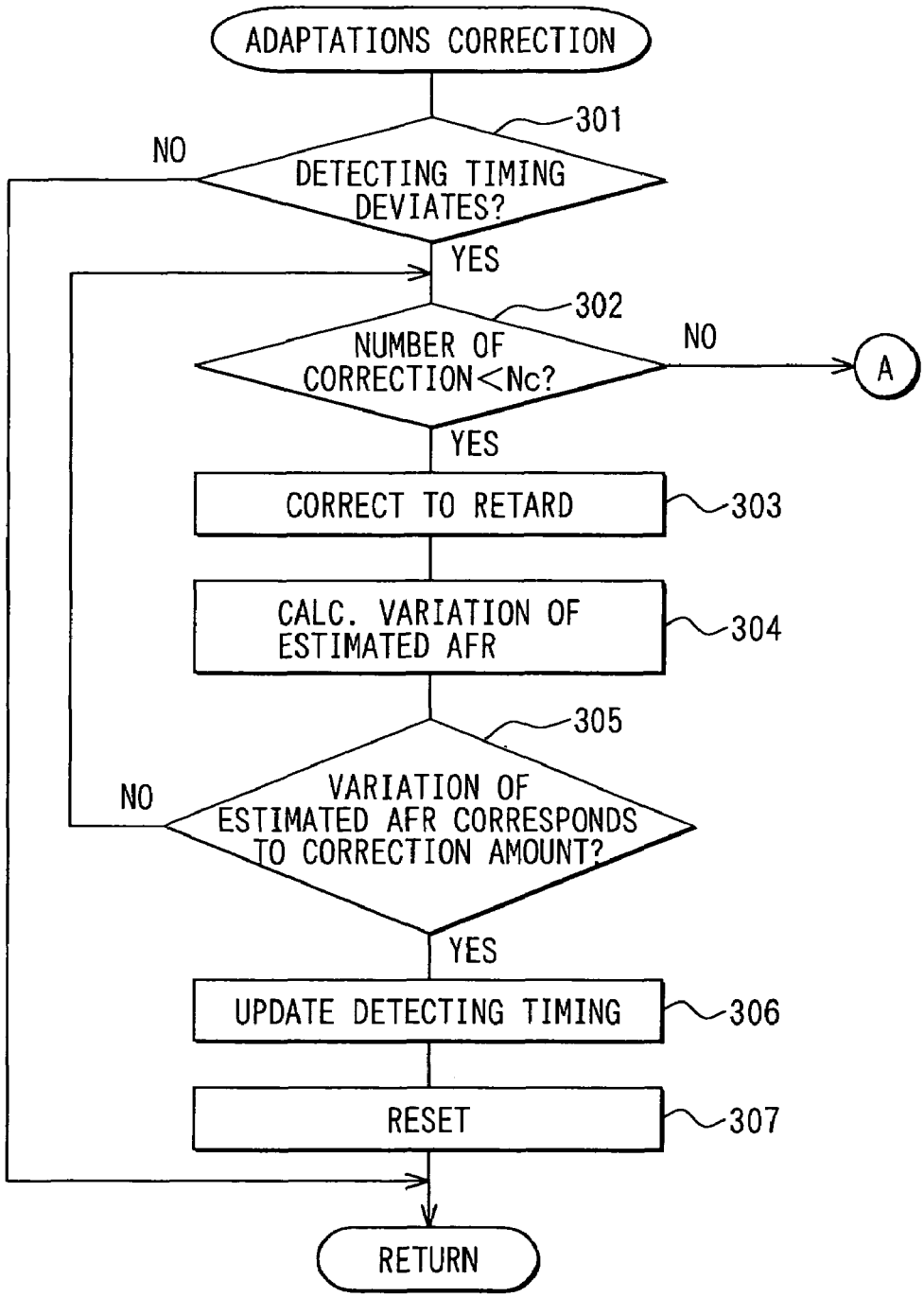
FIG. 6 is a flowchart showing a routine for adaptations correction of the deviation of the air-fuel ratio detecting timing according to the first embodiment.
Figure 7:
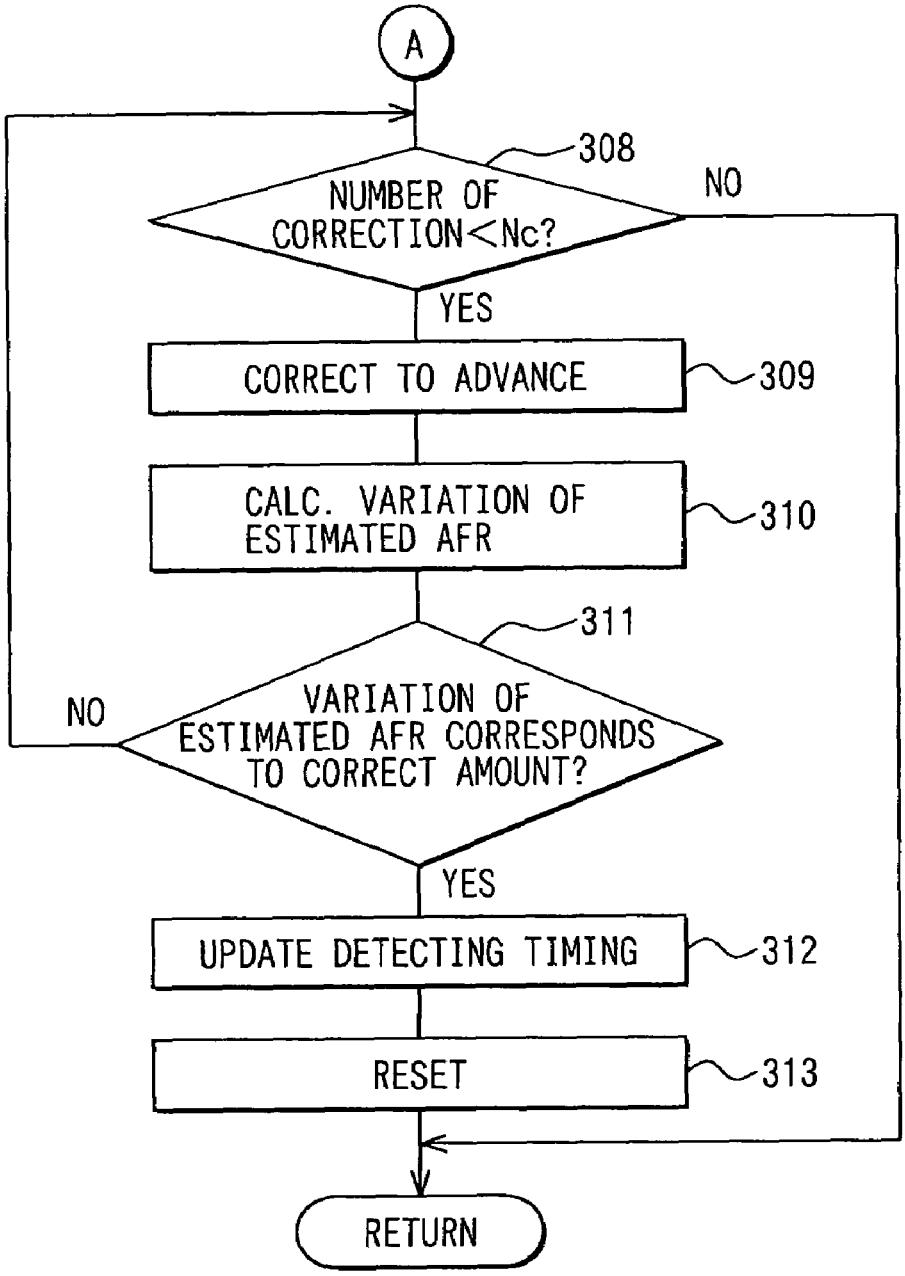
FIG.7 is a flowchart showing a sub-routine for adaptations correction of the deviation of the air-fuel ratio detecting timing according to the first embodiment.

The adaptations correction routine shown in FIGS. 6, 7 is executed after the routine shown in FIG. 5 ends. The adaptations correction routine functions as a means for adaptations. In step 301, the computer determines whether the determination of deviations of the air-fuel ratio detecting timing is executed or not in the routine shown in FIG. 5. When it has not determined that the air-fuel ratio detecting timing deviates, the routine ends without executing following steps.

When it has already determined that the air-fuel ratio detecting timing deviates, the procedure proceeds to step 302, in which it is determined whether the number of retard correction is less than a predetermined number Nc. The number of retard correction is the number of correction in which the air-fuel ratio detecting timing is retarded. When it is Yes in step 302, the procedure proceeds to step 303 in which the air-fuel ratio detecting timing is corrected toward the retard direction by a predetermined angle. In step 304, the air-fuel ratio is estimated before and after the correction of fuel amount in order to obtain the variation of estimated air-fuel ratio therebetween.

In step 305, by determining whether the variation of estimated air-fuel ratio corresponds to the corrected amount of fuel, it is determined that the current air-fuel ratio detecting timing is proper or not. When the current air-fuel ratio detecting timing is not proper, the procedure goes back to step 302 and repeats the retard correction. Before the number of retard correction reaches a predetermined number, and when it is determined that the air-fuel ratio detecting timing becomes proper, the procedure proceeds to step 306 in which the current air-fuel ratio detecting timing is adapted as a proper air-fuel ratio detecting timing. The adapted timing is re-stored in a nonvolatile memory such as backup RAM in the ECU 40. Then, the procedure proceeds to step 307, in which the count of retard correction is reset to end the routine.

When the air-fuel ratio detecting timing does not become proper timing even if the retard correction is executed a predetermined times, the procedure proceeds to step 308 in FIG.7, in which it is determined whether the number of the advance correction is less than a predetermined number Nd. When it is Yes in step 308, the procedure proceeds step 309, in which the air-fuel ratio detecting timing is advanced by a predetermined angle from a first angle which is not corrected. In step 310, the air-fuel ratio is estimated to calculate the variation of estimated air-fuel ratio before and after the correction.

In step 311, by determining whether the variation of the estimated air-fuel ratio corresponds to the corrected amount of fuel, the computer determines whether the current air-fuel ratio detecting timing is proper. When it is No in step 311, the procedure goes back to step 308 to repeat the advance correction. Before the number of the advance correction reaches a predetermined number and when it is determined that the air-fuel ratio detecting timing is proper, the procedure proceeds to step 312. In step 312, the computer adapts the current air-fuel ratio detecting timing is proper air-fuel ratio detecting timing, and re-stores the air-fuel detecting timing in the nonvolatile memory such as backup RAM in the ECU 40. Then, the procedure proceeds to step 313, in which the count of advance correction is reset to end the routine.

The adaptations map made by the routine shown in FIGS. 6, 7 is used in step 102 in air-fuel control routine shown in FIG. 2.

When it is No in step 308, which means the proper air-fuel detecting timing is not adapted, the routine ends.

According to the first embodiment, since the computer determines whether the air-fuel ratio detecting timing deviates based on the dispersion of estimated air-fuel ratio among cylinders during the air-fuel ratio control, the deviation of the air-fuel ratio detecting timing is precisely determined.

According to the first embodiment, the proper air-fuel ratio detecting timing is adapted during the air-fuel ratio control, and the air-fuel ratio detecting timing is properly corrected. Thus, the air-fuel ratio in each cylinder is precisely estimated.

According to the first embodiment, since the air-fuel detecting timing is adapted based on the engine condition, such as the engine load and the engine speed, the accuracy of adaptations is enhanced.

In the present invention, the average deviation of the air-fuel ratio detecting timing can be adapted.

Second Embodiment

AS shown in FIG. 3, when the air-fuel ratio detecting timing is proper, the air-fuel ratio in each cylinder can be precisely estimated. Thereby, the deviation between the estimated air-fuel ratio and the standard air-fuel ratio becomes smaller according as the correct amount of fuel in each cylinder increases, so that dispersion of the estimated air-fuel ratio among the cylinders becomes smaller.

On the other hand, as shown in FIG. 4, when the air-fuel ratio detecting timing deviates, the accuracy of estimated air-fuel ratio derived from the output of the air-fuel sensor 37 is deteriorated. Even when the corrected amount of fuel is increased after the air-fuel ratio control started, the deviation of the estimated air-fuel in each cylinder does not become smaller and the dispersion of the estimated air-fuel ratio among cylinders does not become smaller.

Figure 11:
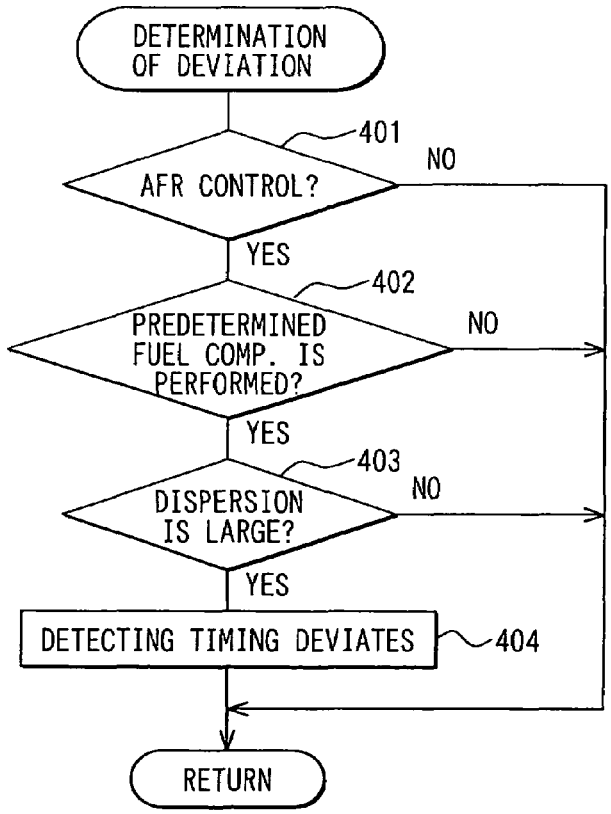
FIG. 11 is a flowchart showing a routine for determining a deviation of the air-fuel ratio detecting timing according to a second embodiment.

According to the second embodiment, the deviation determining routine shown in FIG. 11 is executed. In this routine, the computer determines whether the air-fuel ratio detecting timing deviates based on the dispersion of corrected amount of fuel and the dispersion of estimated air-fuel ratio among the cylinders. This routine is executed every 30°CA of the crank angle in synchronization with the output pulse of the crank angle sensor 33, and functions as a means for determining the deviation of the air-fuel ratio detecting timing. In step 401, it is determined whether the air-fuel ratio control is executing. When it is No, the computer ends the routine without executing the following steps.

On the other hand, when the air-fuel ratio control is executing, the procedure proceeds to step 402, in which it is determined whether a predetermined correction of fuel is executing based on at least one of the following conditions (B1), (B2), (B3).

(B1) It is determined whether a predetermined correction is executing based on whether the deviation between the maximum correct amount of fuel and the minimum correct amount of fuel is larger than a predetermined value.

(B2) It is determined whether a predetermined correction is executing based on whether the standard deviation of all cylinders is larger than a predetermined value.

(B3) It is determined whether a predetermined correction is executing based on whether a predetermined time has elapsed since the correction of fuel.

When it is No in step 402, the routine ends. When it is Yes in step 402, the procedure proceeds to step 403. In step 403, it is determined whether the dispersion of estimated air-fuel ratio among the cylinders is larger than a predetermined value based on at least one of the following conditions (C1), (C2).

(C1) It is determined based on whether the deviation between the maximum estimated air-fuel ratio and the minimum estimated air-fuel ratio is larger than a predetermined value.

(C2) It is determined based on whether the standard deviation is larger than a predetermined value.

When it is determined that the dispersion of the estimated air-fuel ratio among the cylinders is larger than a predetermined value, the procedure proceeds to step 404, in which it is determined that the air-fuel ratio detecting timing deviates to end the routine. When the dispersion of the estimated air fuel is small, which means it is No in step 403, it is determined that the air-fuel detecting timing is proper to end the routine.

According to the second embodiment described above, it is precisely determined the deviation of the air-fuel ratio detecting timing.

Third Embodiment

When the accuracy of estimated air-furl ratio of each cylinder is high, the increase and decrease of the correct amount of fuel coincide with the increase and decrease of the estimated air-fuel ratio. Under such an operation condition of engine, when the correct amount of fuel increases and the estimated air-fuel ratio decreases, and when the correct amount of fuel decreases and the estimated air-fuel ratio increases, it should be considered that the accuracy of estimated air-fuel ratio is not high.

Figure 12:
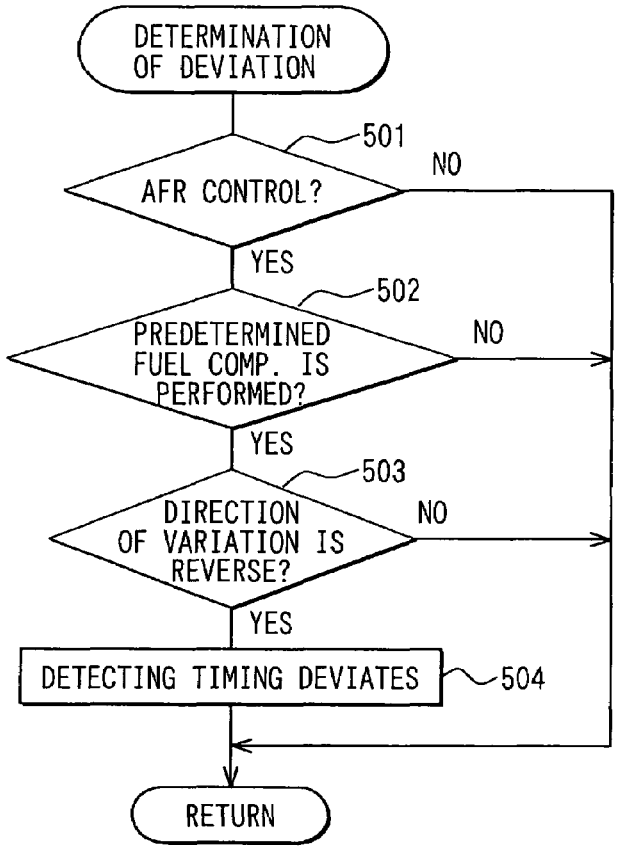
FIG. 12 a flowchart showing a routine for determining a deviation of the air-fuel ratio detecting timing according to a third embodiment.

According to the third embodiment, the determining routine shown in FIG. 12 is executed. In this routine, the deviation of the air-fuel detecting timing is determined based on the direction of variation of the correct amount of fuel and the estimated air-fuel ratio. This routine is executed every 30°CA of the crank angle in synchronization with the output pulse of the crank angle sensor 33, and functions as a means for determining the deviation of the air-fuel ratio detecting timing. In step 501, it is determined whether the computer is executing the air-fuel control. When it is No, the procedure ends.

When it is Yes in step 501, the procedure proceeds to step 502, in which it is determined whether a predetermined correction of fuel is executing based on at least one of the following conditions (D1), (D2).

(D1) It is determined based on whether the deviation between the maximum correct amount of fuel and the minimum correct amount of fuel is larger than a predetermined value.

(C2) It is determined based on whether the correct amount of fuel in a specific cylinder is larger than a predetermined value.

When it is No in step 501, the procedure ends. When it is Yes in step 501, the procedure proceeds to step 503 in which it is determined whether the directions of variation of the correct amount of fuel and the estimated air-fuel ratio are reverse to each other. For example, it is determined based on whether the deviation between the changing rate of the correct amount of fuel and the changing rate of the estimated air-fuel ratio. When it is determined that the directions of variation of the correct amount of fuel and the estimated air-fuel ratio is reverse, the procedure proceeds to step 504, in which it is determined that the air-fuel ratio detecting timing deviates to end the routine. When it is No in step 503, it is determined that the air-fuel detecting timing is proper to end the routine.

According to the third embodiment, the deviation of air-fuel ratio detecting timing is precisely determined.

Fourth Embodiment

Figure 13:
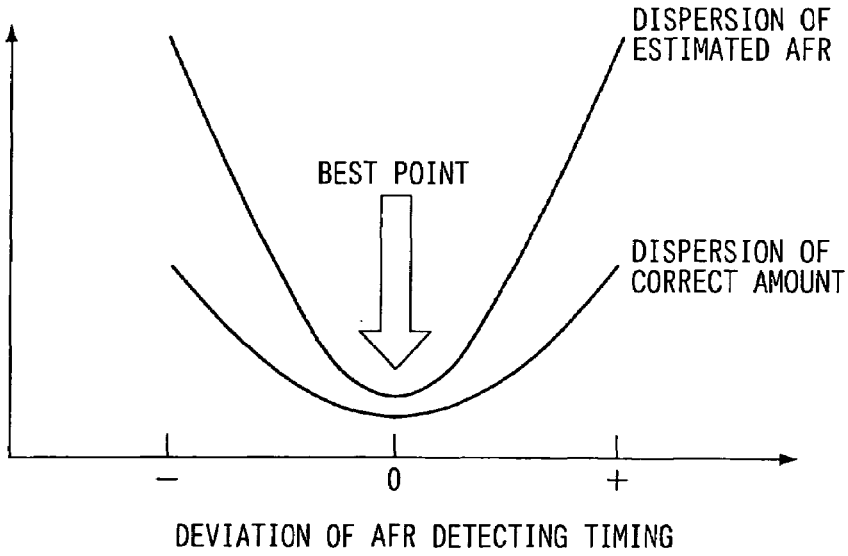
FIG. 13 is a graph for explaining a way of adaptations correction of the deviation of the air-fuel ratio detecting timing according to a fourth embodiment.

When the air-fuel ratio detecting timing is proper, the air-fuel ratio in each cylinder is precisely estimated. Thus, as shown in FIG. 13, at the best point of the air-fuel ratio detecting timing, the dispersion of the estimated air-fuel ratio is minimum and the dispersion of the correct amount of fuel is minimum.

Figure 14:
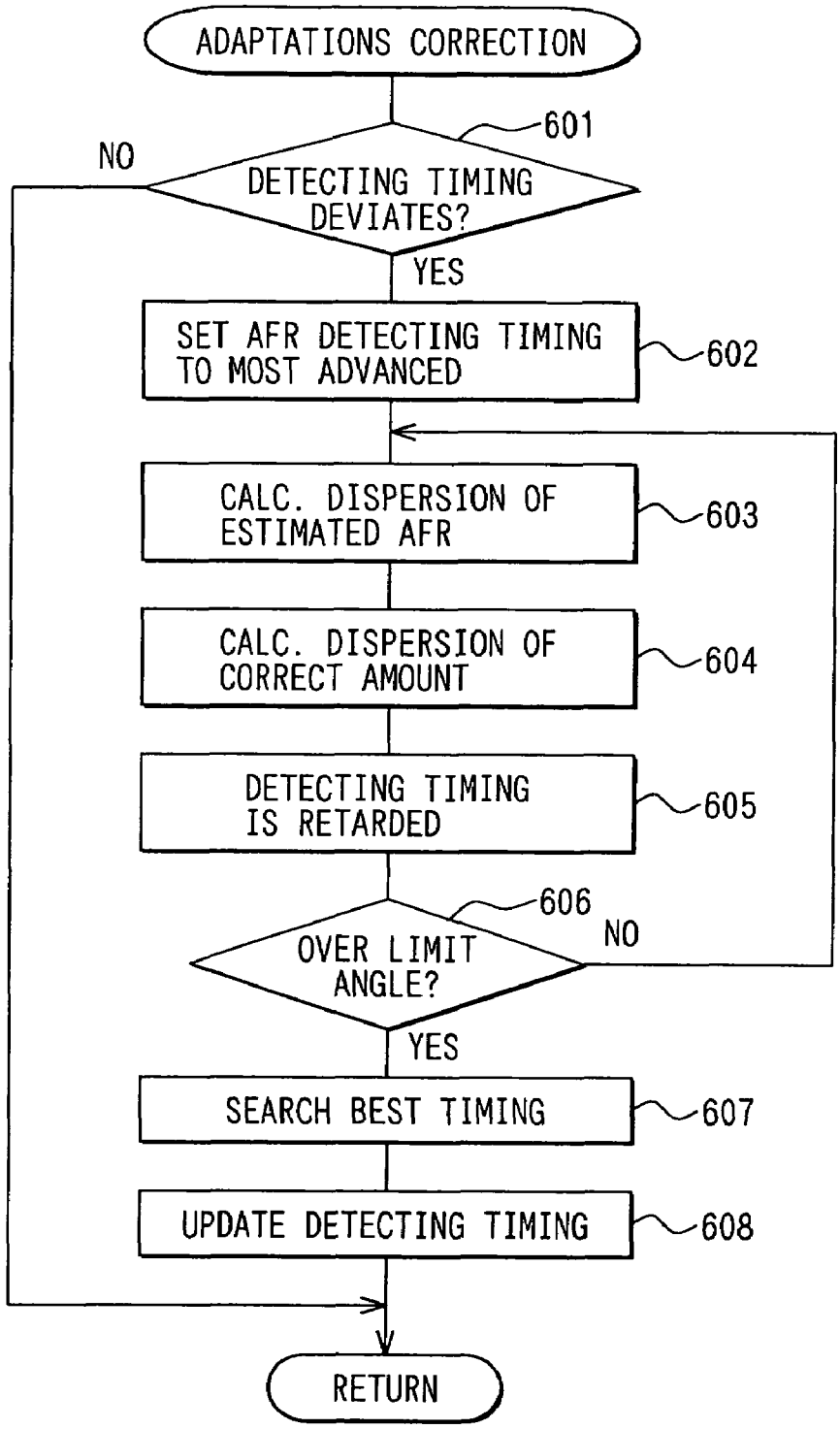
FIG. 14 is a flowchart showing a routine for adaptations correction of the deviation of the air-fuel ratio detecting timing according to the fourth embodiment.

In the fourth embodiment, the adaptations correction routine shown in FIG. 14 is executed, so that the air-fuel ratio in each cylinder is estimated by varying the air-fuel ratio detecting timing during the air-fuel ratio control. Moreover, the most proper air-fuel ratio detecting timing is adapted to minimize the dispersion of the estimated air-fuel ratio among the cylinders and the dispersion of the correct amount of fuel among the cylinders.

This routine is executed after the deviation of air-fuel ratio detecting timing is determined by the determining routine explained in the first to third embodiments. This routine functions as a means for adaptations. In step 601, it is determined whether the determination with respect to the deviation of the air-fuel ratio detecting timing has been executed or not. When it is No, the routine ends without executing the following steps.

On the other hand, when it is determined the air-fuel ratio detecting timing deviates, the procedure proceeds to step 603. In step 603, the dispersion degree of the estimated air-fuel ratio among the cylinders is derived according to one of the ways (E1), (E2) described below.

(E1) The deviation between the maximum estimated air-fuel ratio and the minimum estimated air-fuel ratio is calculated. Then the deviation is set as the dispersion degree of the estimated air-fuel ratio among the cylinders.

(E2) The standard deviation of the estimated air-fuel ratio among the cylinders is calculated. Then the standard deviation is set as the dispersion degree of the estimated air-fuel ratio among the cylinders.

Next, the procedure proceeds to step 604, in which the dispersion is derived according to one of the ways (F1), (F2).

(F1) The deviation between the maximum correct amount of fuel and the minimum correct amount of fuel is calculated. Then the deviation is set as the dispersion degree of the correct amount of fuel among the cylinders.

(F2) The standard deviation of the correct amount of fuel among the cylinders is calculated. Then the standard deviation of the correct amount of fuel is set as the dispersion degree of the correct amount of fuel among the cylinders.

Next, the procedure proceeds to step 605, in which the air-fuel ratio detecting timing is retarded by a predetermined angle. In step 606, it is determined whether the retarded air-fuel ratio detecting timing is advanced over the most retard angle (limit angle of correction). When it is NO, the procedure goes back to step 603 to repeat the procedure described above. Thereby, the air-fuel ratio detecting timing is gradually advanced from the most advanced position to the most retarded position to repeat the calculation of the dispersion degree of the estimated air-fuel ratio and the correct amount of the fuel.

When it is Yes in step 606, the procedure proceeds to step 607, in which the best air-fuel ratio detecting timing is searched to minimize the dispersions of the estimated air-fuel ratio and the correct amount of fuel. In step 608, the best timing in backup RAM of the ECU 40 is updated. The best timing changes according to the operation condition of the engine, so that the adaptations value of the air-fuel ratio detecting timing can be updated every operation condition of the engine.

According to the fourth embodiment, the best point of the air-fuel ratio detecting timing is precisely adapted during the air-fuel ratio control.

In the fourth embodiment, the air-fuel ratio detecting timing is varied from the most advanced position to the most retarded position. When the dispersion degrees of the estimated air-fuel ratio and the correct amount of fuel reach the predetermined value, the procedure calculating the disperse degree can be ended. The timing in which the dispersion is less than a predetermined value can be adapted as the proper air-fuel ratio detecting timing.

Fifth Embodiment

Figure 15:
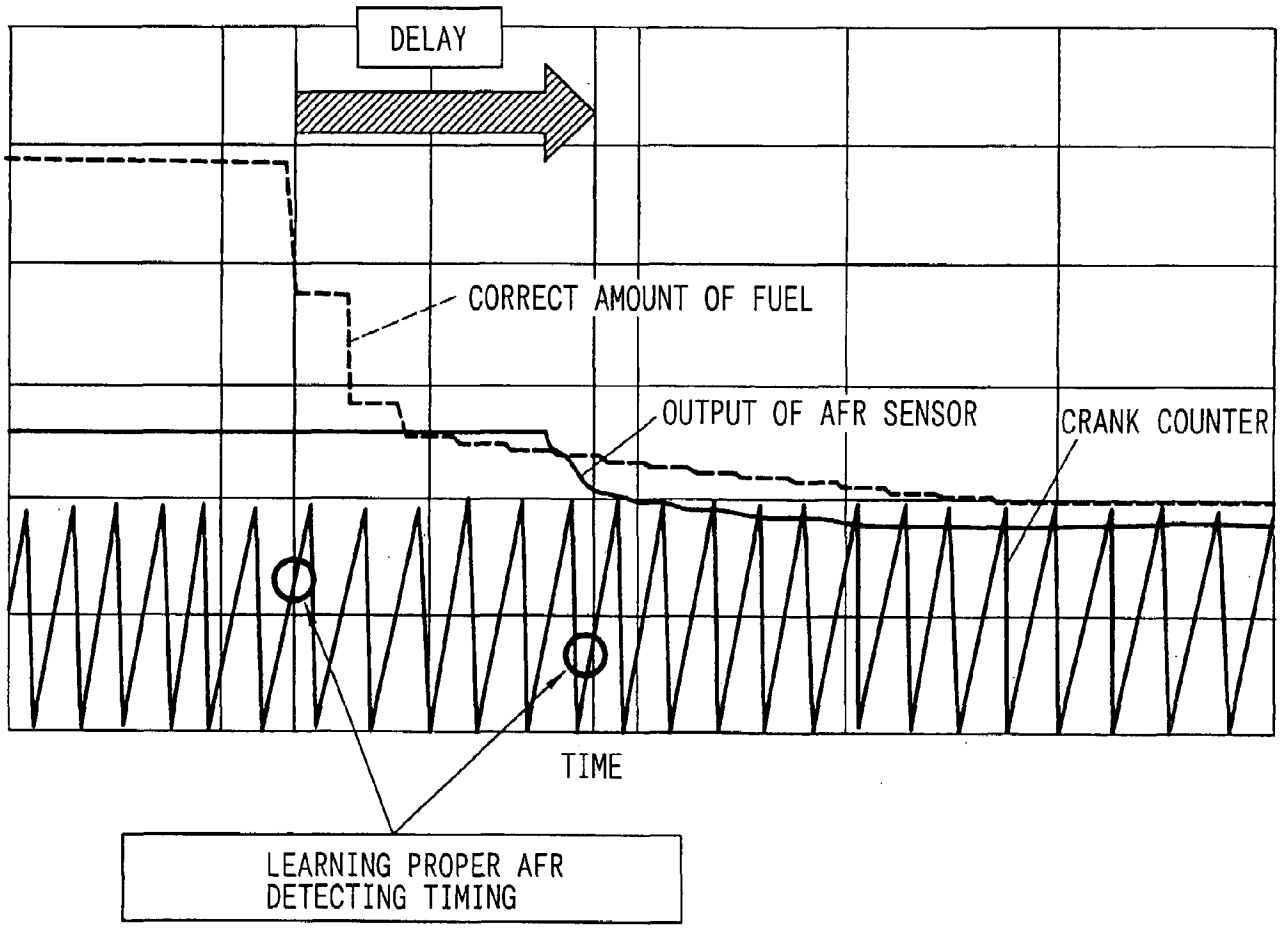
FIG. 15 is a time chart for explaining a way of adaptations correction of the deviation of the air-fuel ratio detecting timing according to a fifth embodiment.

As shown in FIG. 15, in the event of stopping the fuel-cut, the timing, in which the output of the air-fuel ratio sensor 37 becomes the output corresponding to the air-fuel ratio after the fuel is re-injected, depends on the cylinder into which the fuel is injected first after the fuel-cut is stopped. The other cylinders do not affect the timing.

Figure 16:
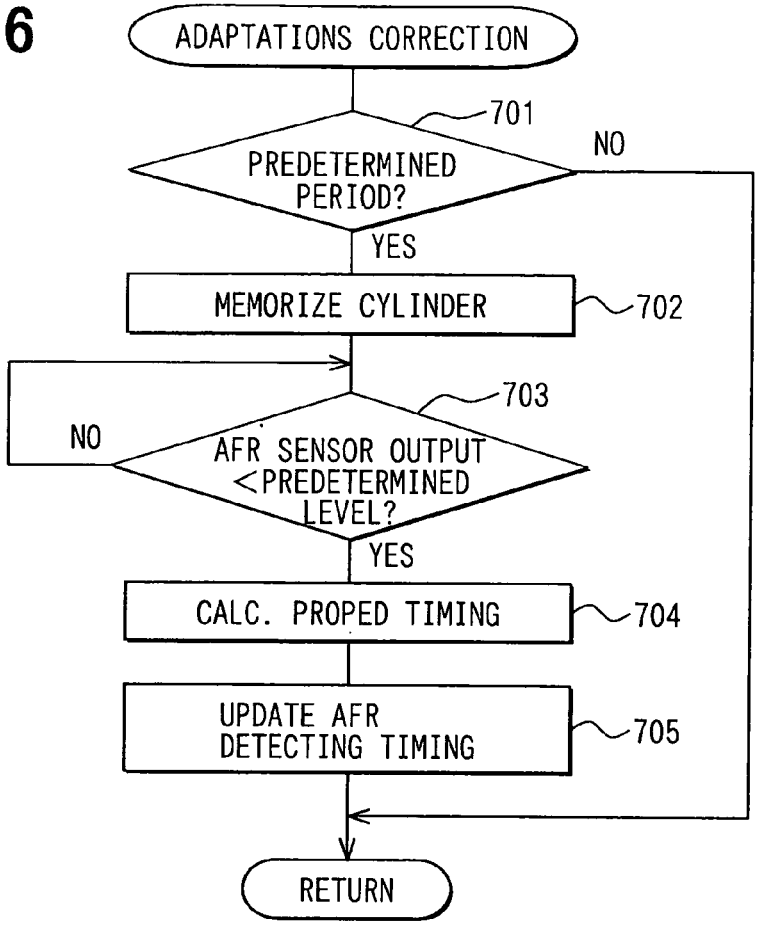
FIG. 16 is a flowchart showing a routine for adaptations correction of the deviation of the air-fuel ratio detecting timing according to the fifth embodiment.

In the fifth embodiment, the adaptations correct routine shown in FIG. 16 is executed to adapt a proper air-fuel ratio detecting timing when the fuel-cut is stopped.

The routine is executed every 30°CA of crank angle in synchronization with the output pulse of the crank angle sensor 33. In step 701, the computer determines whether it is within a predetermined period after the fuel-cut is stopped. When it is No, the routine ends without executing following steps. The above predetermined period is a little longer than a period in which the output signal of the air-fuel ratio sensor 33 reaches a predetermined level corresponding to the air-fuel-ratio after the fuel injection is re-conducted. When the variation of the operation condition of engine, such as the engine speed and the engine load, exceeds a predetermined value, the routine ends because large variation of the operation condition of engine deteriorates the accuracy of adaptations.

When it is Yes in step 701, the procedure proceeds to step 702. In step 702, the cylinder of which the fuel-cut is finished is stored in the RAM of the ECU 40. In step 703, the procedure waits until the output of the air-fuel ratio sensor 37 reaches to the predetermined level corresponding to the air-fuel ratio after the fuel injection is re-conducted. The predetermined level can be varied according to the operation condition of engine, such as the engine speed, the engine load and the correct amount of fuel.

In step 704, a proper air-fuel ratio detecting timing is calculated based on the deviation between the crank angle in which the output of the air-fuel ratio sensor 37 reaches the predetermined level corresponding to the air-fuel ratio after fuel injection is re-conducted, and the crank angle of the cylinder into which the fuel injection is re-conducted.

In step 705, the air-fuel ratio detecting timing is updated and stored in the backup RAM of the ECU 40. The air-fuel ratio detecting timing can be updated every operation condition of the engine.

According to the fifth embodiment, the best point of the air-fuel ratio detecting timing is precisely adapted during the air-fuel ratio control.

The deviation of the air-fuel ratio detecting timing in a specific cylinder is adapted as an average deviation in all cylinders.

Sixth Embodiment

Referring to FIGS. 17 to 23, the sixth embodiment is described.

The correlation value which indicates the relationship between the variation of estimated air-fuel ratio in at least one cylinder and the variation of the correct amount of fuel is used as the data which determine the deviation of the air-fuel detecting timing.

The correlation value is represented by a product of the variation of the estimate air-fuel ratio of a single cylinder and the variation of correct amount of fuel of the single cylinder. Alternatively, the correlation value can be represented by a sum of the products. In the sixth embodiment, the products of the variation of the estimated air-fuel ratio in each cylinder and the variation of the correct amount of fuel are integrated to obtain the correlation value.

Furthermore, the calculating timing of the correlation value is set as multiple timing per 720°CA, for example, a base timing, the base timing +180°CA, the base timing −180 °CA, the base timing +360°CA, the base timing +90°CA, and the base timing −90°CA, and it is determined that the timing of which correlation value is largest is the air-fuel detecting timing of which deviation is smallest.

As explained in the third embodiment, when the directions of variation of the correction amount and the estimated air-fuel ratio are opposite directions, the accuracy of the estimate air-fuel is low. In addition, the signals (±) of the variation of the estimated air-fuel ratio and the correct amount of fuel are opposite to each other. Thus, the product of both has minus signal and the correlation value becomes small. Therefore, the deviation of the air-fuel ratio timing decreases according as the correlation value increases. Based on this relationship, the correlation value is calculated at multiple timing per 720°CA, and it is determined that the timing of which correlation value is largest is the air-fuel ratio detecting timing of which deviation is smallest. This air-fuel ratio detecting timing is adapted. This function corresponds to a correction means of parameter.

The determining and adaptations correction of the air-fuel ratio detecting timing is executed by the ECU 40 according to flow charts shown in FIGS. 17 to 22.

Figure 17:
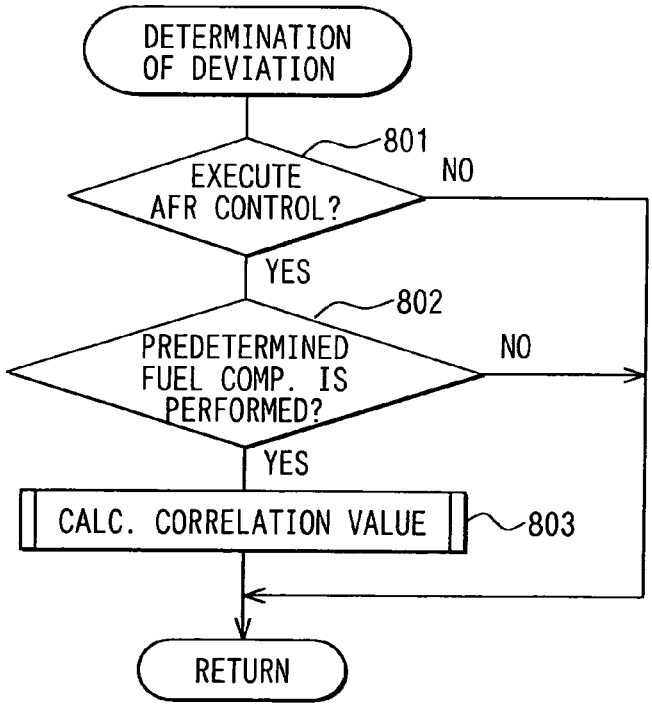
FIG. 17 is a flowchart showing a routine for determining a deviation of the air-fuel ratio detecting timing according to a sixth embodiment.

The routine shown in FIG. 17 is executed every 30°CA of crank angle in synchronization with the output signal of the crank angle sensor 33. Instep 801, the computer determines whether the air-fuel control is executed. When it is NO, the routine ends without executing following steps.

Figure 18:
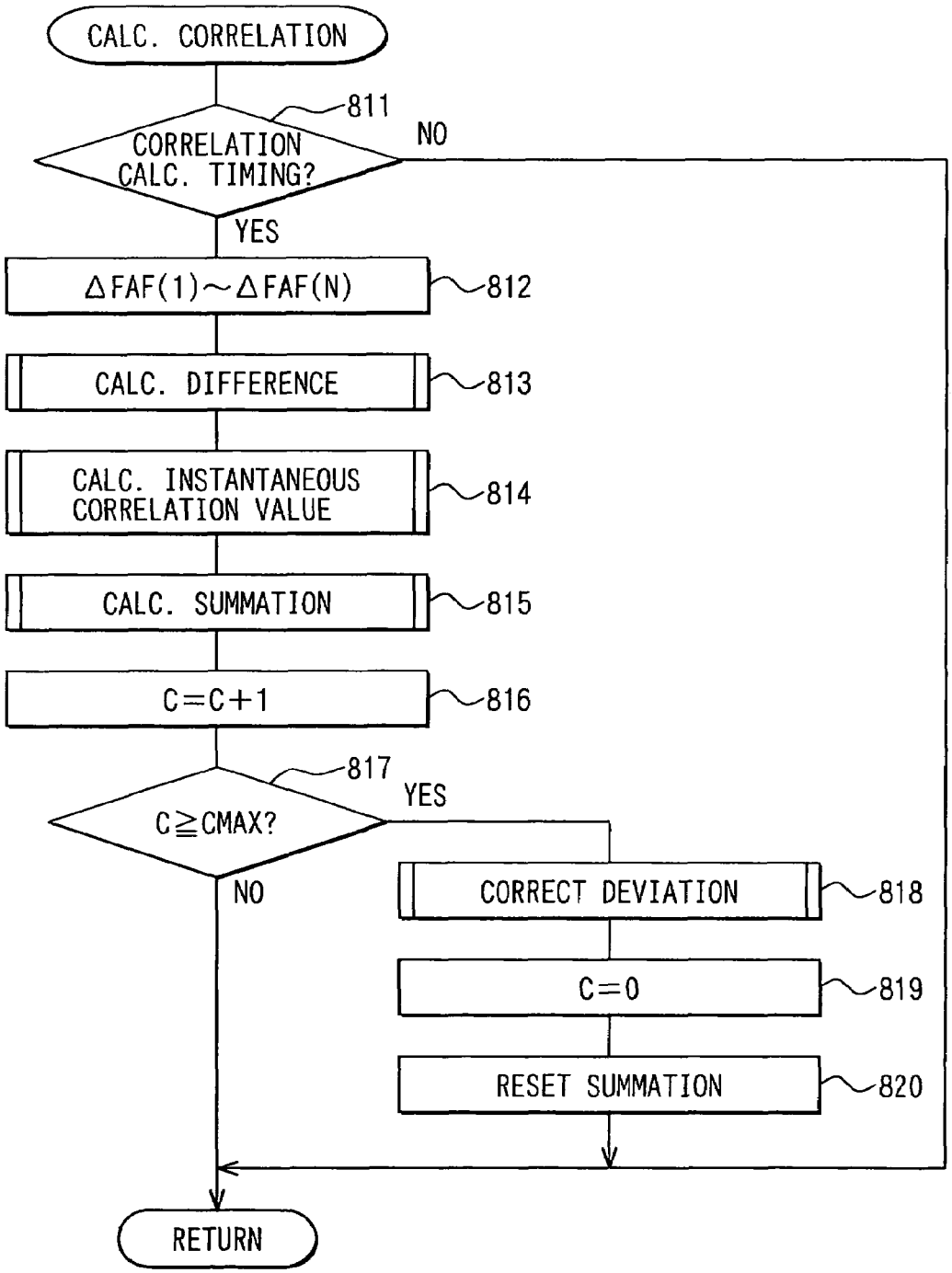
FIG. 18 is a flowchart showing a routine for calculating a correlation value according to the sixth embodiment.

When it is Yes in step 801, the procedure proceeds to step 802, in which it is determined whether a correction of the fuel is executed over a predetermined times as well as Step 502 in FIG. 12. When it is No in step 802, the routine ends. When it is Yes in step 802, the procedure proceeds to step 803 in which a routine for calculating the correlation value, shown in FIG. 18, is executed.

In step 811, the computer determines whether it is in the correlation value calculating timing every 720°CA. When it is NO in step 811, the routine ends without executing the following steps.

When it is Yes in step 811, the procedure proceeds to step 812 in which differentials ΔFAF(1)–ΔFAF(N) corresponding to the variation amount of the fuel correct coefficient are calculated based on the following equation.

$$\Delta FAF(k)=\Delta FAF(k)[i]-\Delta FAF(k)[i-1]$$

Here, ΔFAF(k) is a ΔFAF of No."k" cylinder (k=1–N). ΔFAF(k)[i] is a current ΔFAF(k), and ΔFAF(k)[i−1] is a previous ΔFAF(k).

Figure 19:
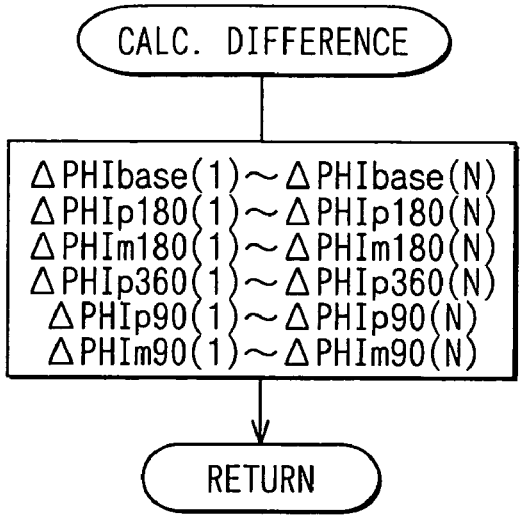
FIG. 19 is a flowchart showing a routine for calculating a deference of estimated air-fuel ratio according to the sixth embodiment.
Figure 20:
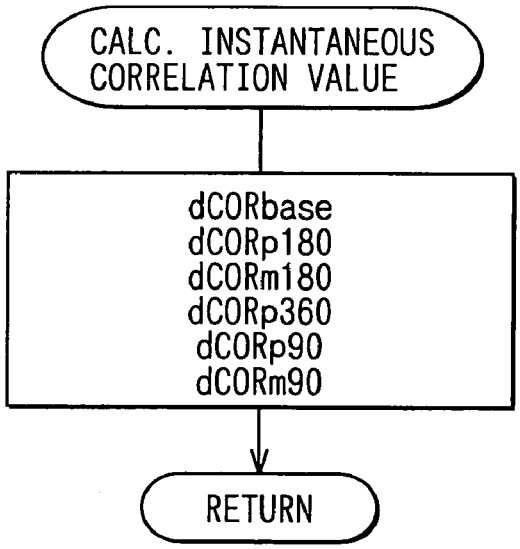
FIG. 20 is a flowchart showing a routine for calculating an instantaneous correlation value according to the sixth embodiment.

The procedure proceeds to step 813 in which a routine for calculating a difference of estimated air fuel ratio, which is shown in FIG. 19, is executed to derive the difference ΔPHI corresponding to the variation amount of the estimated air-fuel ratio in each cylinder at the timing (T1) to (T6).

(T1): ΔPHIbase at the base timing

ΔPHIbase(k)=PHIbase(k)[i]−ΔPHIbase(k)[i−1](k=1 to N)

ΔPHIbase(k)is the estimated air-fuel ratio of No."k" cylinder at the base timing. The base timing is a standard air-fuel ratio detecting timing, which is corrected by a correction routine shown in FIG. 22.

(T2): ΔPHIp180 at the time of base timing +180°CA

ΔPHIp180(k)=PHIp180(k)[i]−ΔPHIp180(k)[i−1]base (k=1 to N)

ΔPHIp180(k) is the estimated air-fuel ratio of No."k" cylinder at the time of the base timing +180°CA.

(T3): ΔPHIm180 at the time of base timing −180°CA

ΔPHIp180(k)=PHIp180(k)[i]−ΔPHIp180(k)[i−1](k=1 to N)

ΔPHIm180(k) is the estimated air-fuel ratio of No."k" cylinder at the time of the base timing −180°CA.

(T4): ΔPHIp360 at the time of base timing +360°CA

ΔPHIp360(k)=PHIp360(k)[i]−ΔPHIp360(k)[i−1](k=1 to N)

ΔPHIm360(k) is the estimated air-fuel ratio of No."k" cylinder at the time of the base timing +360 °CA.

(T5): ΔPHIp90 at the time of the base timing +90 °CA

ΔPHIp90(k)=PHIp90(k)[i]−ΔPHIp90(k)[i−1](k=1 to N)

ΔPHIm90(k) is the estimated air-fuel ratio of No."k" cylinder at the time of the base timing +360°CA.

(T6): ΔPHIm90 at the time of the base timing −90°CA

ΔPHIm90(k)=PHIm90(k)[i]−ΔPHIm90(k)[i−1](k=1 to N)

ΔPHIm90(k) is the estimated air-fuel ratio of No."k" cylinder at the time of the base timing −90°CA.

PHIbase(k) to PHIm90(k) are derived based on the equivalence ratio ϕ.

Equivalence ratioϕ=Stoichiometric air-fuel ratio/Estimated air-fuel ratio=1/Excess air ratio After ΔPHI at each timing (T1) to (T6) are calculated, the procedure proceeds to step 814 of the routine shown in FIG. 18, in which a routine for calculating an instantaneous correlation value is executed to derive the instantaneous correlation value dCOR at the timing (T1) to (T6).

(T1): dCORbase at the base timing dCORbase=Σ{ΔFAF(k)×ΔPHIbase(k)} (k=1 to N)

(T2): dCORp180 at the time of base timing +180°CA dCORp180=Σ{ΔFAF(k)×ΔPHIp180(k)} (k=1 to N)

(T3): dCORm180 at the time of base timing −180°CA dCORm180=Σ{ΔFAF(k)×ΔPHIm180(k)} (k=1 to N)

(T4): dCORp360 at the time of base timing +360°CA dCORp360=Σ{ΔFAF(k)×ΔPHIp360(k)} (k=1 to N)

(T5): dCORp90 at the time of base timing +90°CA dCORp90=Σ{ΔFAF(k)×ΔPHIp90(k)} (k=1 to N)

(T6): dCORm90 at the time of base timing −90°CA dCORm90=Σ{ΔFAF(k)×ΔPHIm90(k)} (k=1 to N)

Figure 21:
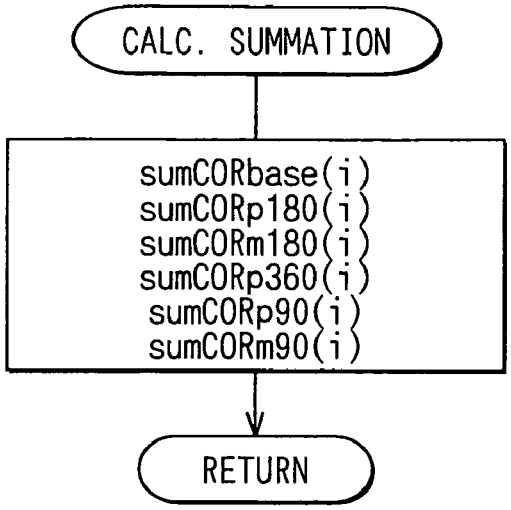
FIG. 21 is a flowchart showing a routine for calculating a summation correlation value according to the sixth embodiment.
Figure 22:
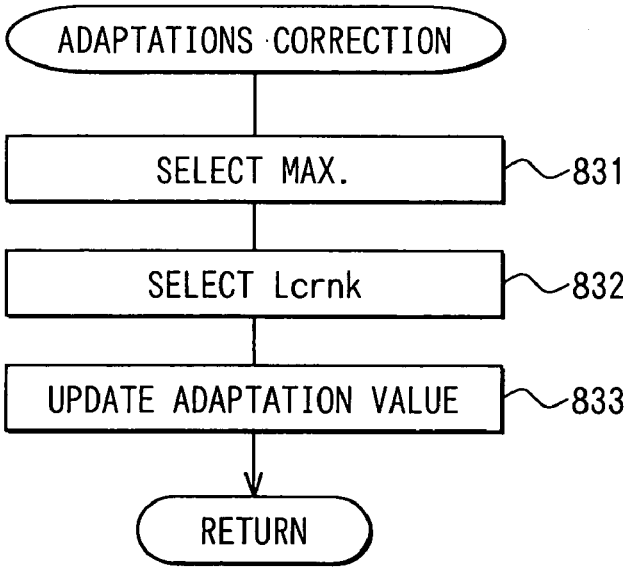
FIG. 22 is a flowchart showing a routine for adaptations correction of the deviation of the air-fuel ratio detecting timing according to the sixth embodiment.

After dCOR at each timing (T1) to (T6) are calculated, the procedure proceeds to step 815 of the routine shown in FIG. 18, in which a routine, shown in FIG. 21, for calculating a summation correlation value is executed to derive the summation correlation value sumCOR at the timing (T1) to (T6).

(T1): sumCORbase(i) at the base timing sumCORbase(i)=sumCORbase(i−1)+dCoRbase (sumcoRbase(i−1) is previous sumCORbase)

(T2): sumCORp180(i) at the time of the base timing +180°CA sumCORp180(i)=sumCORp180(i−1)+dCORp180

(sumCORp180(i−1) is previous sumCORp180)

(T3): sumCORm180(i) at the time of the base timing −180°CA sumCORm180(i)=sumCORm180(i−1)+dCORm180

(sumCORm180(i−1) is previous sumCORm180)

(T4): sumCORp360(i) at the time of the base timing +360°CA sumCORp360(i)=sumCORp360(i−1)+dCORp360

(sumCORm360(i−1) is previous sumCORp360)

(T5): sumCORp90(i) at the time of the base timing +90°CA sumCORp90(i)=sumCORp90(i−1)+dCORp90

(sumCORp90(i−1) is previous sumCORp90)

(T6): sumCORm90(i) at the time of the base timing −90°CA sumCORm90(i)=sumCORm90(i−1)+dCORm90

(sumCORm90(i−1) is previous sumCORm90)

After sumCOR at each timing (T1) to (T6) are calculated, the procedure proceeds to step 816 of the routine shown in FIG. 18, in which the counter C for counting the number of summation of dCOR is incremented. In step 817, the computer determines whether the number of the counter C reaches the maximum CMAX (for example, 25). When it is No, the routine ends.

When the number of counter C reaches the maximum CMAX, the procedure proceeds to step 818 in which the correct routine for adaptations the deviation of the air-fuel ratio detecting timing is executed. The deviation of the air-fuel detecting timing is adapted and corrected as follows. In step 831, the maximum sumCOR is selected among sumCORbase(i), sumCORp180(i), sumCORm180(i), sumCORp360(i), sumCORp90(i), and sumCORm90(i).

Next, the procedure proceeds to step 832, in which the correction amount Lcrnk of air-fuel ratio detecting timing is selected according to the timing in which the sum correlation value is maximum. The procedure is processed as follows.

(T1): In a case that sumCORbase(i) is maximum at the base timing

The correction amount Lcrnk=0

(T2): In a case that the sumCORp180 is maximum at the time of base timing +180°CA The correction amount Lcrnk=+180°CA (T3): In a case that the sumCORm180(i) is maximum at the time of base timing −180°CA The correction amount Lcrnk=−180°CA (T4): In a case that the sumCORp360(i) is maximum at the time of base timing +360°CA The correction amount Lcrnk=+360°CA (T5): In a case that the sumCORp90(i) is maximum at the time of base timing +90°CA The correction amount Lcrnk=+30°CA (T6): In a case that the sumCORm90(i) is maximum at the time of base timing −90°CA Here, when the sumCORbase(i) is maximum, the deviation of the air-fuel ratio detecting timing is smallest at the base timing. In this case, the correction amount Lcrnk is zero.

When the summation correlation value is maximum at the time of base timing ±180°CA, +360°CA, it means that the air-fuel detecting timing deviates over 180°CA. Such a large deviation causes an estimation of air-fuel ratio of incorrect cylinder, so that it is necessary to immediately correct the deviation of the air-fuel detecting timing. Thus, the correction amount Lcrnk is set as ±180°CA, +360°CA in order to correct the deviation of the air-fuel detecting timing.

When the summation correlation value is maximum at the time of base timing ±90°CA, it means the current air-fuel detecting timing is close to proper timing. In this case, the air-fuel ratio detecting timing is precisely corrected, so that the deviation of the air-fuel ratio detecting timing is corrected by 30°CA.

In step 833, the correction amount Lcrnk is updated and stored in the backup RAM as the correction amount Lcrnk selected in step 832. Then, procedure proceeds to step 819 in which the counter C is reset. In step 820, the summation correlation values at the timing (T1) to (T2) are reset to end the routine.

Figure 23:
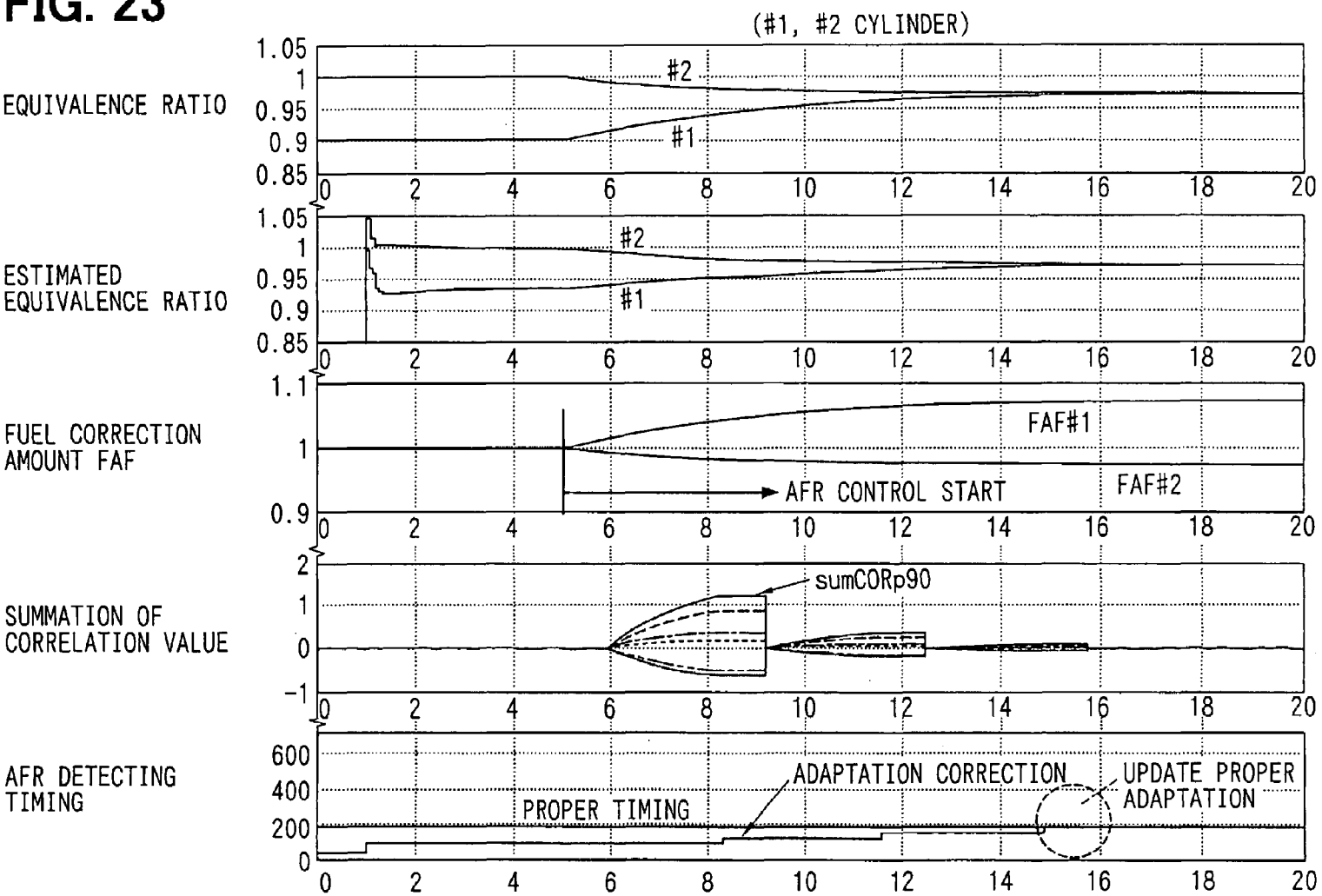
FIG. 23 is a time chart showing adaptations correction of a deviation of the air-fuel ratio detecting timing.

FIG. 23 is a time chart showing adaptations correction of the air-fuel ratio detecting timing according to the sixth embodiment. In FIG. 23, among the summation correlation values at the timing (T1) to (T2), the summation correlation value sumCORp90 at the timing of base timing +90°CA is maximum, so that the deviation of air-fuel ratio detecting timing is corrected by 30°CA.

As described above, in the sixth embodiment, the procedure deriving the instantaneous correlation value is executed at multiple timing per 720°CA, the instantaneous correlation value is accumulated every timing, the summation correlation value is calculated, and the deviation of air-fuel ratio detecting timing is corrected. Thus, the deviation of air-fuel ratio detecting timing is accurately adapted and corrected.

Furthermore, according to the sixth embodiment, the effect of noise instantaneously arose can be reduced.

The correlation value can be derived as to single cylinder or some cylinders less than all cylinders.

The present invention can be applied to not only an intake port injection engine but also a direct injection engine.

What is claimed is:

1. A cylinder-by-cylinder air-fuel ratio controller for an internal combustion engine, comprising:

an air-fuel ratio sensor detecting an air-fuel ratio of an exhaust gas, the air-fuel ratio sensor being disposed in a confluent portion into which the exhaust gas from each cylinder flows;

an air-fuel ratio estimating means which estimates air-fuel ratios cylinder-by-cylinder based on an output of the air-fuel ratio sensor every air-fuel ratio detecting timing;

an air-fuel ratio control means which controls the air-fuel ratio of each cylinder based on an estimated air-fuel ratios; and a determining means which determines a deviation of the air-fuel ratio detecting timing based on a dispersion of the estimated air-fuel ratio among the cylinders while the air-fuel ratio control means controls the air-fuel ratio.

2. A cylinder-by-cylinder air-fuel ratio controller for an internal combustion engine, comprising:

an air-fuel ratio sensor detecting an air-fuel ratio of an exhaust gas, the air-fuel ratio sensor being disposed in a confluent portion into which the exhaust gas from each cylinder flows;

an air-fuel ratio estimating means which estimates air-fuel ratios cylinder-by-cylinder based on an output of the air-fuel ratio sensor every air-fuel ratio detecting timing;

an air-fuel ratio control means which controls the air-fuel ratio of each cylinder based on an estimated air-fuel ratios; and a determining means which determines a deviation of the air-fuel ratio detecting timing based on a dispersion of a correct amount of fuel among the cylinders and a dispersion of the estimated air-fuel ratio among the cylinders while the air-fuel ratio control means controls the air-fuel ratio.

3. A cylinder-by-cylinder air-fuel ratio controller for an internal combustion engine, comprising:

an air-fuel ratio sensor detecting an air-fuel ratio of an exhaust gas, the air-fuel ratio sensor being disposed in a confluent portion into which the exhaust gas from each cylinder flows;

an air-fuel ratio estimating means which estimates air-fuel ratios cylinder-by-cylinder based on an output of the air-fuel ratio sensor every air-fuel ratio detecting timing;

an air-fuel ratio control means which controls the air-fuel ratio of each cylinder based on an estimated air-fuel ratios; and a determining means which determines a deviation of the air-fuel ratio detecting timing based on a variation direction of a correct amount of fuel and an estimated air-fuel ratio.

4. A cylinder-by-cylinder air-fuel ratio controller for an internal combustion engine, comprising:

an air-fuel ratio sensor detecting an air-fuel ratio of an exhaust gas, the air-fuel ratio sensor being disposed in a confluent portion into which the exhaust gas from each cylinder flows;

an air-fuel ratio estimating means which estimates air-fuel ratios cylinder-by-cylinder based on an output of the air-fuel ratio sensor every air-fuel ratio detecting timing;

an air-fuel ratio control means which controls the air-fuel ratio of each cylinder based on an estimated air-fuel ratios; and a parameter correction means which corrects a parameter used by the air-fuel estimating means based on a relationship between a variation amount of an estimated air-fuel ratio of at least one cylinder and a variation amount of a correct amount of fuel of the cylinder.

5. The cylinder-by-cylinder air-fuel ratio controller for an internal combustion engine according to claim 4, wherein the parameter correction means employs a product of the variation amount of estimated air-fuel ratio and the variation amount of correct amount of fuel as a correlation value indicating the relationship.

6. The cylinder-by-cylinder air-fuel ratio controller for an internal combustion engine according to claim 5, wherein the parameter correction means employs a summation of the products with respect to a plurality of cylinders.

7. The cylinder-by-cylinder air-fuel ratio controller for an internal combustion engine according to claim 5, wherein the parameter correction means calculates the correlation value at a plurality of timing per 720°CA, and determines a timing having a largest correlation value as an air-fuel ratio detecting timing having a smallest deviation.

8. The cylinder-by-cylinder air-fuel ratio controller for an internal combustion engine according to claim 5, wherein the parameter correction means employs a value that is derived by calculating the correlation values in a predetermined interval and integrating the correlation values for a predetermined period.

9. The cylinder-by-cylinder air-fuel ratio controller for an internal combustion engine according to claim 5, wherein the parameter corrected by the parameter correction means is the air-fuel ratio detecting timing.

10. A cylinder-by-cylinder air-fuel ratio controller for an internal combustion engine, comprising:

an air-fuel ratio sensor detecting an air-fuel ratio of an exhaust gas, the air-fuel ratio sensor being disposed in a confluent portion into which the exhaust gas from each cylinder flows;

an air-fuel ratio estimating means which estimates air-fuel ratios cylinder-by-cylinder based on an output of the air-fuel ratio sensor every air-fuel ratio detecting timing;

an air-fuel ratio control means which controls the air-fuel ratio of each cylinder based on an estimated air-fuel ratios; and an adaptations means which estimates an air-fuel ratio of each cylinder by varying an air-fuel ratio detecting timing, and adapts a proper air-fuel ratio detecting timing in which a variation amount of the estimated air-fuel ratio corresponds to a correct amount of fuel.

11. A cylinder-by-cylinder air-fuel ratio controller for an internal combustion engine, comprising:

an air-fuel ratio sensor detecting an air-fuel ratio of an exhaust gas, the air-fuel ratio sensor being disposed in a confluent portion into which the exhaust gas from each cylinder flows;

an air-fuel ratio estimating means which estimates air-fuel ratios cylinder-by-cylinder based on an output of the air-fuel ratio sensor every air-fuel ratio detecting timing;

an air-fuel ratio control means which controls the air-fuel ratio of each cylinder based on an estimated air-fuel ratios; and an adaptations means which estimates an air-fuel ratio of each cylinder by varying an air-fuel ratio detecting timing, and adapts a proper air-fuel ratio detecting timing in which a dispersion of an estimated air-fuel ratio among the cylinders and a dispersion of a correct amount of fuel among the cylinders are minimum or less than a predetermined value.

12. A cylinder-by-cylinder air-fuel ratio controller for an internal combustion engine, comprising:

an air-fuel ratio sensor detecting an air-fuel ratio of an exhaust gas, the air-fuel ratio sensor being disposed in a confluent portion into which the exhaust gas from each cylinder flows;

an air-fuel ratio estimating means which estimates air-fuel ratios cylinder-by-cylinder based on an output of the air-fuel ratio sensor every air-fuel ratio detecting timing;

an air-fuel ratio control means which controls the air-fuel ratio of each cylinder based on an estimated air-fuel ratios; and an adaptations means which adapts a proper air-fuel ratio detecting timing of a cylinder in which a fuel-cut is terminated first based on a timing in which the output of the air-fuel ratio sensor becomes a value corresponding to an air-fuel ratio after a fuel injection is reconducted.

13. The cylinder-by-cylinder air-fuel ratio controller for an internal combustion engine according to claim 10, wherein the adaptations means adapts a proper air-fuel ratio detecting timing every operation condition of the internal combustion engine.

14. The cylinder-by cylinder air-fuel ratio controller for an internal combustion engine according to claim 1, wherein the air-fuel ratio estimating means which estimates air-fuel ratios cylinder-by-cylinder based on a model in which the output of the air-fuel ratio sensor is modeled in such manner that historical data of the estimated air-fuel ratio and historical data of the output of the air-fuel ratio sensor are respectively multiplied by a predetermined value and are summed up together.

* * * * *